US008206249B1

(12) United States Patent
Wise

(10) Patent No.: US 8,206,249 B1
(45) Date of Patent: Jun. 26, 2012

(54) ELECTRONIC RACQUET STRINGING MACHINE

(75) Inventor: Herbert H. Wise, Los Angeles, CA (US)

(73) Assignee: Herbert H. Wise, Los Angeles, CA (US)

( * ) Notice: Subject to any disclaimer, the term of this patent is extended or adjusted under 35 U.S.C. 154(b) by 0 days.

(21) Appl. No.: 13/083,458

(22) Filed: Apr. 8, 2011

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS

| | | | | | |
|---|---|---|---|---|---|
| 4,376,535 | A * | 3/1983 | Muselet et al. | 473/556 |
| 4,417,729 | A * | 11/1983 | Morrone | 473/556 |
| 5,026,055 | A * | 6/1991 | Longeat | 473/556 |
| 5,080,360 | A * | 1/1992 | Longeat | 473/556 |
| 5,733,212 | A * | 3/1998 | Wise et al. | 473/557 |
| 5,820,500 | A * | 10/1998 | Raos | 473/557 |
| 6,162,139 | A * | 12/2000 | Bassili | 473/557 |
| 6,227,990 | B1 * | 5/2001 | Wise et al. | 473/557 |
| 6,583,590 | B1 * | 6/2003 | Chu | 318/34 |
| 6,837,811 | B1 * | 1/2005 | Wu | 473/557 |
| 7,153,226 | B1 * | 12/2006 | Van Der Pols | 473/557 |
| 7,192,370 | B2 * | 3/2007 | van der Pols | 473/557 |
| 7,686,713 | B2 * | 3/2010 | Severa et al. | 473/557 |
| 7,695,383 | B2 * | 4/2010 | Severa et al. | 473/557 |
| 7,833,118 | B2 * | 11/2010 | Severa et al. | 473/557 |
| 7,980,968 | B1 * | 7/2011 | Van Der Pols | 473/557 |
| 8,066,593 | B2 * | 11/2011 | Severa et al. | 473/557 |
| 2003/0027670 | A1 * | 2/2003 | van der Pols | 473/557 |
| 2008/0254922 | A1 * | 10/2008 | Severa et al. | 473/556 |
| 2008/0254923 | A1 * | 10/2008 | Severa et al. | 473/557 |
| 2011/0111893 | A1 * | 5/2011 | Severa et al. | 473/556 |

* cited by examiner

*Primary Examiner* — Raleigh W. Chiu
(74) *Attorney, Agent, or Firm* — Lawrence S. Cohen

(57) ABSTRACT

A tension head for a racquet stringing machine in which roller bearings are used between the outer vice plates and the vice jaws. Also, a pin on one vice jaw extends into a slot in an outer vice plate and in the slot is an adjustable screw which allows override of the compression on string upon contact with the pin. Also a follower is mounted on the lead screw and steadied by a guide bar in order to reduce spurious movement of the snatch vice during operation.

5 Claims, 21 Drawing Sheets

ELECTRONIC RACQUET STRINGING MACHINE

FIELD OF INVENTION

The present invention relates to racket stringing machines.

RELATED PATENTS

U.S. Pat. Nos. 5,733,212 and 6,227,990 are related to this invention

THE PRIOR ART

Many machines have been devised for stringing and restringing game rackets, such as those used for tennis, badminton, squash and the like.

After 1969, a process that had previously been done by guess, intuition or the displacement of fixed weights (Serrano, U.S. Pat. No. 2,188,250) became more efficient and precise by using the compression of a spring with its inherent linearity (Held, U.S. Pat. No. 3,441,275) as a comparator. Here the stringing machine (FIG. 15) holds the racket in a cradle in a position parallel to the ground 130. The person stringing a racket threads the string through a hole in the racket frame, attaching one end to the racket and the other to an external self-tightening vise 131 (snatch vise). The vise is part of a hand cranked tensioning assembly 132 (tension head) that automatically when the tension on the string equals the tension preset on the helical bias spring. The tension head runs on a track 133 that draws the string away from the racket while tensioning. This is the so-called Pull and Brake method.

Modified, Held's device is still used universally although its accuracy is often called into question, its resolution is limited, and it needs frequent calibration. In substantially similar forms this machine is manufactured by Ektelon, Gamma, Alpha, Czech Sports, Eagnas, Toalson, Gossen, Kennex, Winn, and others.

From 1975, machines surfaced that used electric motors to replaced the hand crank that compresses the bias spring (Kaminstein, U.S. Pat. No. 3,918,713), (Tcuchida, U.S. Pat. No. 4,6020,705), and (Muselet et al., U.S. Pat. No. 4,376,535).

When wooden rackets became obsolete, rackets of aluminum, graphite, boron, ceramic, Kelvar, etc. made their appearance along with hundreds of kinds of new strings made of different plastics and multi-layered filaments. Improvements to the equipment required an improvement in the accuracy of the tools needed for their stringing and thus electronic machines.

Babolat of France (U.S. Pat. No. 5,026,055) and Poreex of Taiwan (U.S. Pat. No. 5,090,697) manufacture essentially duplicate electronic machine sold under their own name and brand labeled for others. In their device the snatch vise is driven by a spring-loaded chain drive.

Not unlike earlier machines the chain drive compresses a helical spring. Running parallel to this bias spring is a linear potentiometer. The electronics read the linear potentiometer as it measures the spring compression and indirectly the tension on the string through the intermediary of the chain/spring potentiometer assembly.

All electronic machines are "Constant Pull" machines and continue to apply tension even after the dialed-in tension is reached because strings lose some tension seconds after their initial pull. This Constant Pull feature is often the cause of undesirable results. Knowledgeable players ask their stringer which machine will be used to string their racket, mechanical (Pull and Brake) or electronic (Constant Pull). The results can be substantially different. Electronic machines will invariably produce a racket that is 5-10 percent tighter (where it appears as if more tension has been applied to the strings) than a Pull and Brake machine. Professional players claim they can feel the difference in small fractions of a pound.

As can be seen, both mechanical and electronic machines read the applied tension to the racket string indirectly, that is, as a relationship to a bias spring.

A version of an electronic stringing machine that reads the tension applied to the racket string directly and consequently more accurately is described in U.S. Pat. No. 5,733,212 and U.S. Pat. No. 6,227,990 (Wise et al.). This tensioning device replaced mechanical tension heads used on mechanical machines. The resulting devices were made transportable, more durable, less complicated, and easier to repair. The input value of the tensioning device were displayed digitally, and any irregularities the electronics uncovered were reported with error codes.

DETAILED DESCRIPTION

Figure 1:
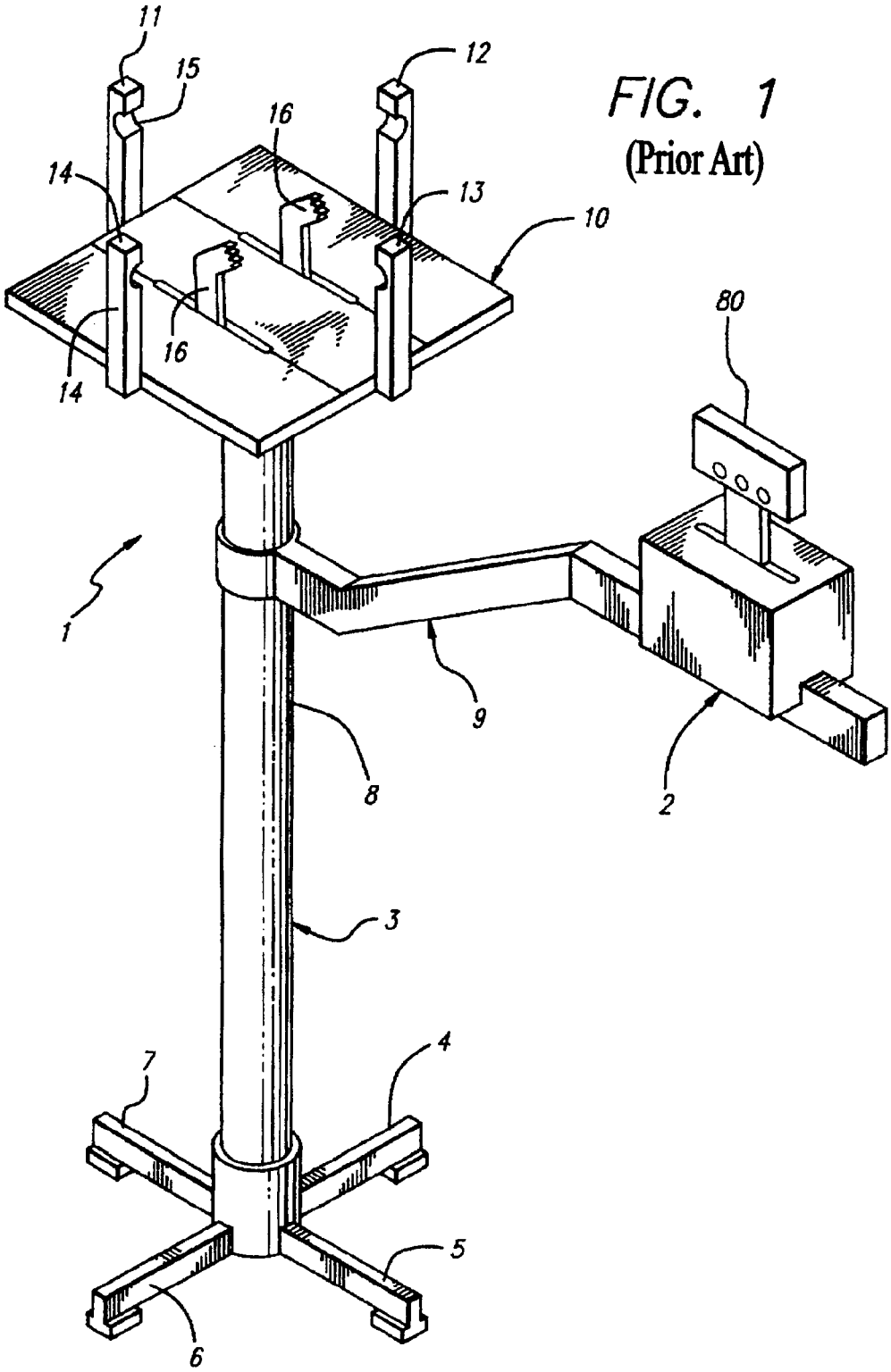
FIG. 1 (Prior Art)
FIG. 1 is a view in perspective of the applicant's stringing machine.

FIG. 1 is a view of applicant's stringing machine with its two major components, the racket cradle assembly 1 and the tension head assembly 2. The stringing machine has a base 3 including legs 4, 5, 6 and 7 spaced from each other at 90 degrees. The base also includes a vertical support column 8, on top of which is fitted the racket cradle assembly tension bar 9. Mounted on the support column and above the tension bar is the racket cradle assembly which takes the form of a turntable. Both the tension bar and the racket cradle assembly pivot on the support column so that when a racket is mounted onto the cradle, as we will see, the string can be aligned from the point it leaves the racket frame to where it enters the snatch vise 80.

The racket cradle assembly platen 10 has two functions; to support four movable posts or fixing elements 11, 12, 13 and 14 that are placed at the top, bottom and two sides of the racket and ensure the horizontal clamping in position of the tennis racket to be strung. The elements 11, 12, 13 and 14 are arranged in exactly the same way so it is sufficient to describe only one of them, for example fixing element 11. The fixing element 11 is grooved 15 and fitted with a non-skid surface to grasp the tennis frame firmly.

The elements are arranged and fixed to the racket cradle platen, opposite one another about the longitudinal axis of the racket cradle, which corresponds to the axis of symmetry of the racket. The elements are adjusted to accept any size racket by moving their supporting bracket, and when pressed against the outer wall of the racket frame support the frame from distortion during the stringing process. Once the four fixing elements support the racket, the elements are firmly locked into place. The racket cradle assembly platen also supports two string clamps 16. These clamps move freely on the racket cradle platen through slots in the platen, but once they are appropriately positioned to hold the string, a single motion of the lever arm 17 locks the string in the clamp and firmly seats the clamp onto the platen. One of the clamps holds the racket end of the string while the loose end of the string is being tensioned by the tension head assembly. Once the string is tensioned, the second clamp holds the string under tension. The process is repeated after the racket is rotated 180 degrees and the loose end of the string is woven anew into the next hole in the racket frame.

The particular design of the racket cradle is not important to the present invention and the racket cradles in the following United States patents can be used as part of the present invention: (1) U.S. Pat. No. 5,090,697 on Racket Frame Stringing Machine issued to Lee on Feb. 25, 1992; (2) U.S. Pat. No. 5,080,360 on Equipment For Stringing A Tennis Racket issued to Longeat on Jan. 14, 1992; (3) U.S. Pat. No. 5,186,505 on Chucking Device Of Racket Stringing Machine issued to Chu on Feb. 16, 1993; (4) U.S. Pat. No. 5,026,055 on Equipment For Stringing A Tennis Racket issued to Longeat on Jun. 25, 1991; (5) U.S. Pat. No. 4,874,170 on String Clamp For Racket Stringing Machine issued to Zech on Oct. 17, 1989; (6) U.S. Pat. No. 4,620,705 on Racket Stringing Device issued to Tsuchida on Nov. 4, 1986; (7) U.S. Pat. No. 4,417,729 on Racket Stringing Apparatns issued to Morrone on Nov. 29, 1983; (8) U.S. Pat. No. 4,546,977 on Racquet Stringing Machine With Improved Racquet Retaining Standard issued to Bosworth, Jr. et al., on Oct. 15, 1985; (9) U.S. Pat. No. 4,376,535 on Machine For Stringing Rackets issued to Muselet et al., on Mar. 15, 1983; (10) U.S. Pat. No. 4,366,958 on Racket Stringing Machines issued to Bosworth on Jan. 4, 1983; (11) U.S. Pat. No. 4,348,024 on Racket Stringing Apparatus And Method issued to Balaban on Sep. 7, 1982; (12) U.S. Pat. No. 3,918,713 on Racket Stringing Machine issued to Kaminstein on Nov. 11, 1975; and (13) U.S. Pat. No. 3,441,275 on Racket Stringer issued to Held on Apr. 29, 1969. The specifications and drawings of each of these 13 listed United States patents are hereby incorporated herein as though set forth in full.

Figure 2:
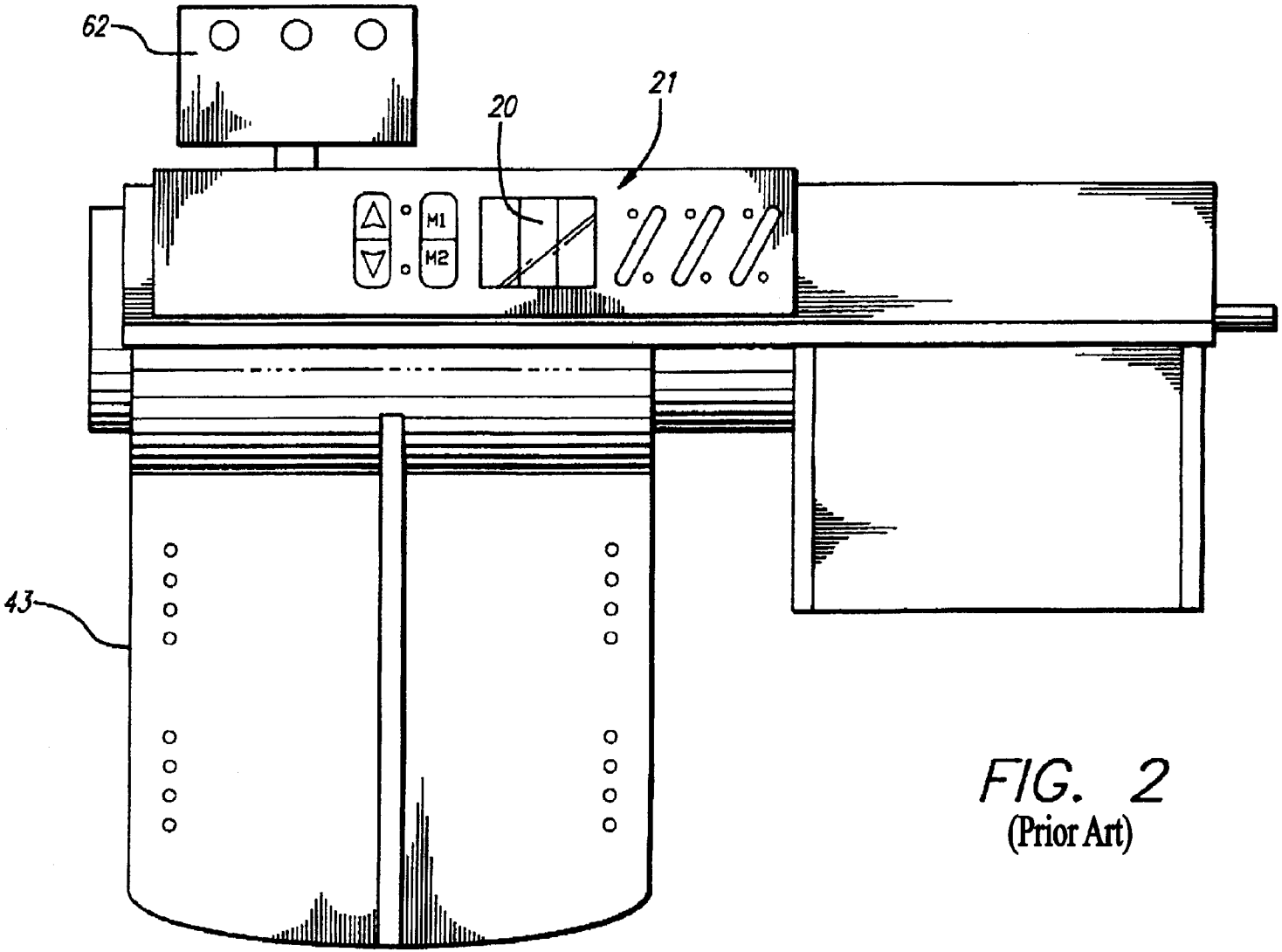
FIG. 2 (Prior Art)
FIG. 2 is a view in perspective of the tension head enclosure and keypad.
Figure 7:
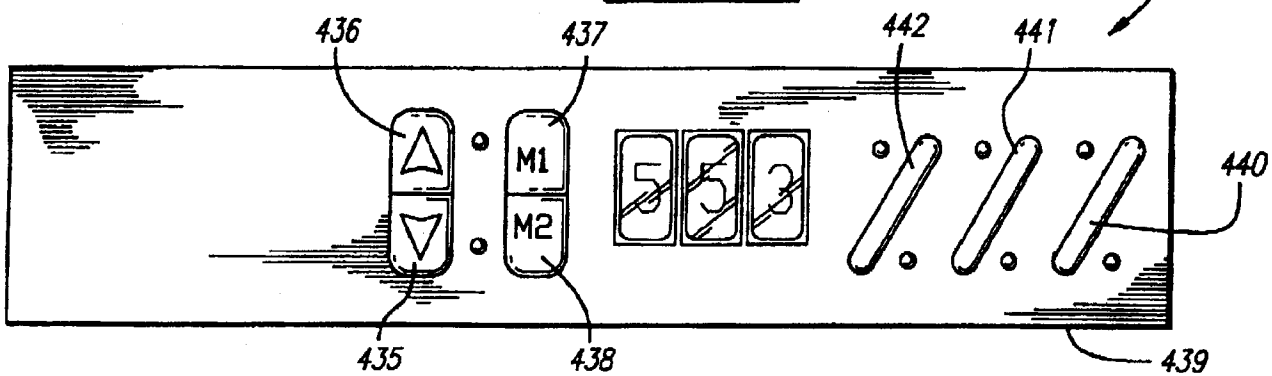
FIG. 7 (Prior Art)
FIG. 7 is a view of the keypad.

FIG. 2 is a perspective view of the tension head enclosure (showing the display window 20 the keypad area 21, the enclosure stand 43 and the brace 62. The keypad is shown in FIG. 7.

Figure 3:
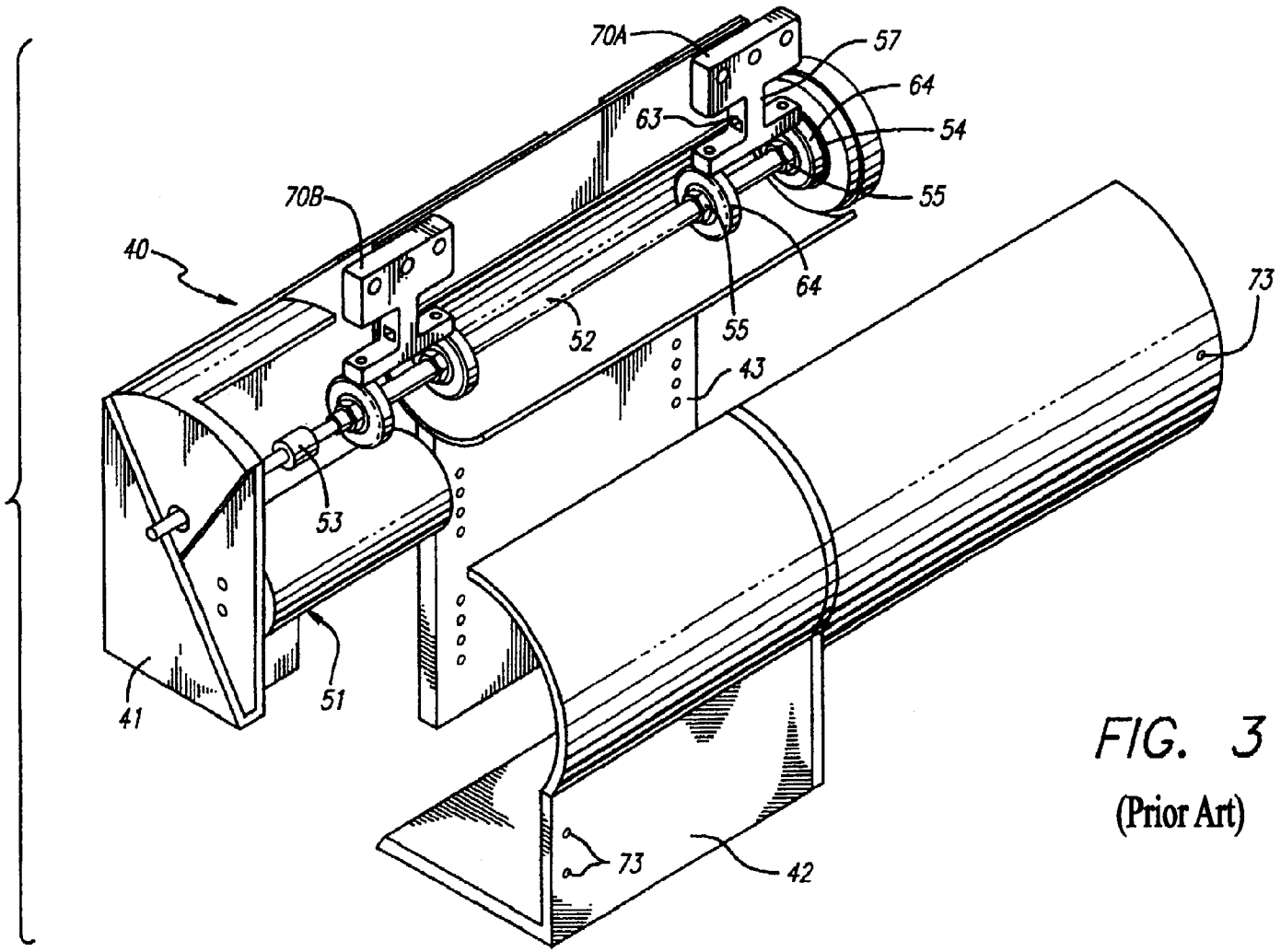
FIG. 3 (Prior Art)
FIG. 3 is a view in perspective of the tension head assembly, opened.

FIG. 3 is a perspective view of the tension head assembly. The tension head assembly 40 consists of four assemblies; (the motor drive screw assembly with gear motor 51, lead screw 52 (other types of ball screws can be used), coupler 53 and bearing 54 and the screw nuts 55; the snatch vise cradle assembly with the snatch vise 80 (not shown here), brace 62 with the attached strain gauges 63, the left and right flanges 64, and the left and right nuts 55; the electronic controller assembly; and the tension head enclosure 41 and back cover assembly 42. Four screws 73 secure the tension head enclosure back cover to the tension head enclosure. In FIG. 3 the snatch vise assembly is shown twice, in its forward 70A and its retracted positions 70B. The tension head assembly stand 43 is mounted with four bolts onto the racket cradle assembly tension bar 9 and allows for height alignment of the tension head with various types of racket cradle assemblies.

The gear motor (preferably a DC motor) and its drive shaft are mounted longitudinally, with the motor gearbox secured to the tension head enclosure inner wall. The coupler is located on the end of the motor drive shaft.

The lead screw 52 is connected to the motor drive shaft via the coupler 53. The coupler has two set screws to secure the end of the lead screw to the end of the motor drive shaft. The opposite end of the lead screw is slid into the bearing 54. Said bearing is located in a recess within the enclosure wall 57 closest to the racket cradle assembly.

Figure 4:
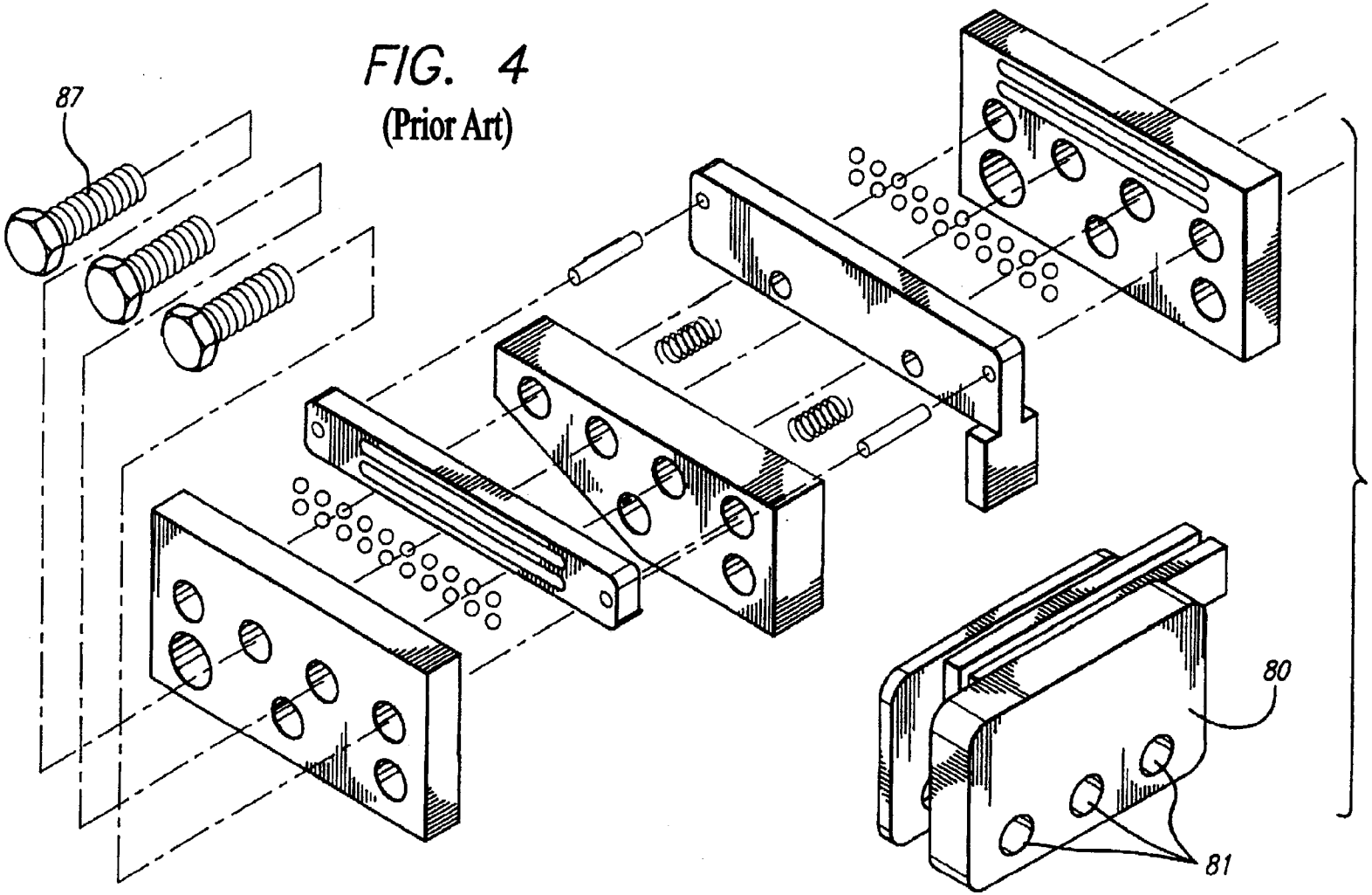
FIG. 4 (Prior Art)
FIG. 4 is a view in perspective of the snatch vise according to the previous version of the device.
Figure 5:
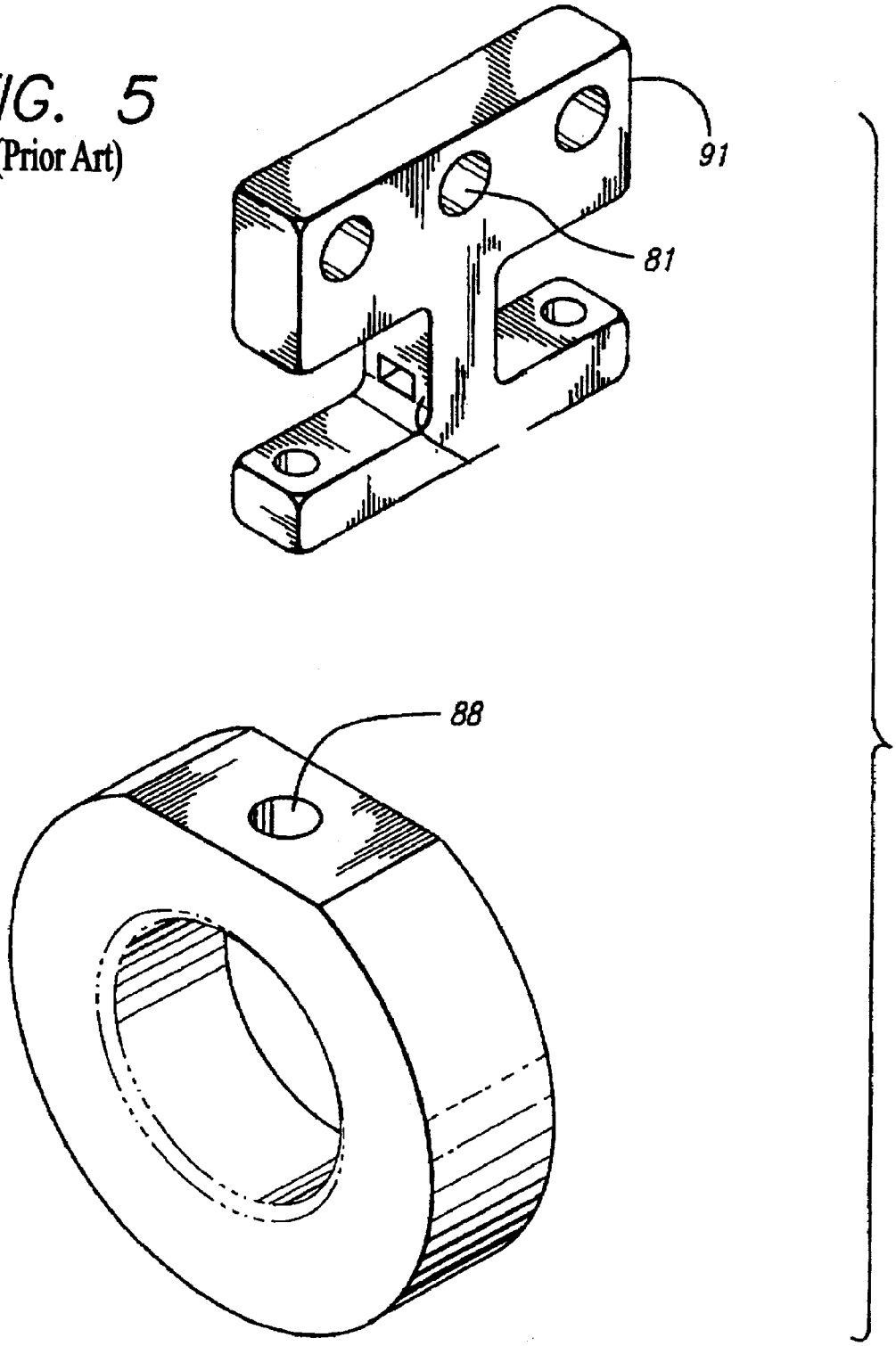
FIG. 5 (Prior Art)
FIG. 5 is a view in perspective of the brace and flange according to the previous version of the device.

FIG. 4 shows the snatch vise 80. The lower half of the snatch vise contains an opening which is slightly wider than the thickness of the brace. The top of the brace FIG. 5, 91 fits within said opening where the three holes 81 in the top of the brace align with the three holes in the lower half of the snatch vise and is secured to the top of the brace by three bolts 87. Onto the brace are mounted the compression strain gauge and the tension strain gauge FIG. 5.

Turning back to FIG. 3, the right flange is aligned, just beneath the brace, on the right side of the brace. The top of the right flange contains a tapped hole (FIG. 5, 88) which aligns with a through hole in the right side of the brace. A bolt secures the right flange to the right side of the brace. The left flange is attached to the left side of the brace in a similar manner. Both flanges are secured perpendicular to the brace and parallel to each other. The right nut contains both inner threads and outer threads. The outer threads of the right nut match the inner threads of the right flange. The right nut is screwed into the right flange, with the unthreaded portion of the right nut outer thread under the brace. The left nut is secured to the left flange in a similar manner. The inner threads of both the right and left nuts match the thread of the lead screw of the motor drive screw assembly.

The snatch vise carriage assembly is connected to the motor drive screw assembly by screwing the lead screw, of the motor drive screw assembly into both nuts of the snatch vise carriage assembly. The snatch vise carriage assembly is thus allowed to translate the length of the lead screw in both directions by applying a positive or a negative voltage to the gear motor.

The sides of the brace of the snatch vise carriage assembly align with the walls of the tension head enclosure and the tension head enclosure back cover. Said walls prohibit the snatch vise carriage assembly from any rotational motion, while allowing the snatch vise carriage assembly to translate in the direction parallel to the racket cradle assembly tension head bar.

Figure 6:
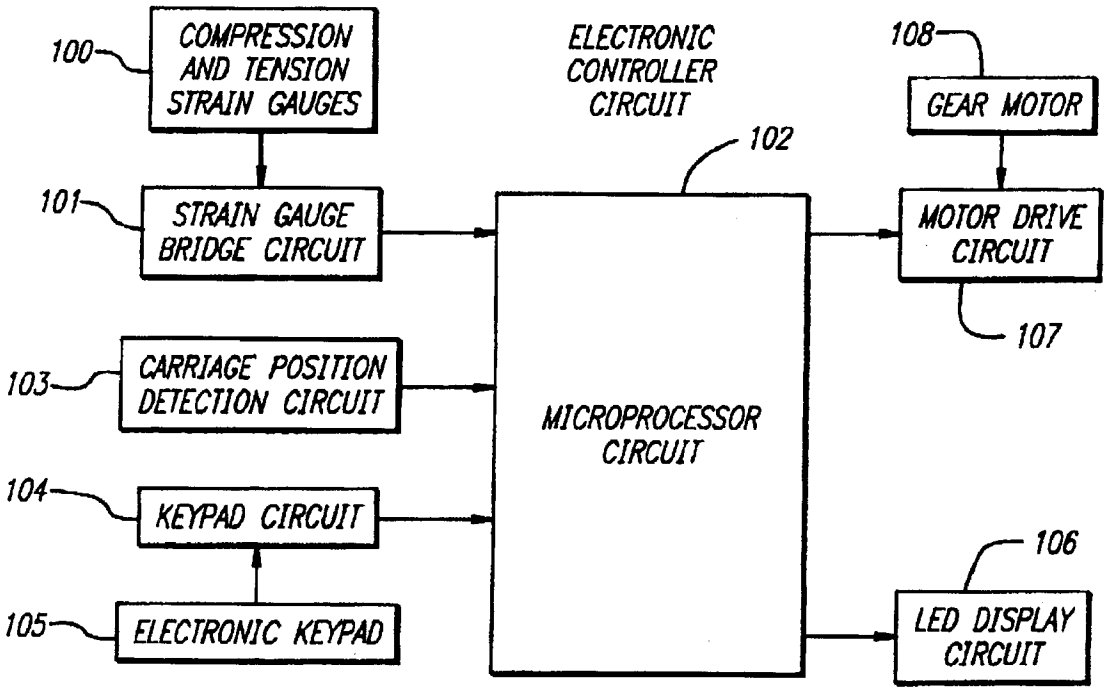
FIG. 6 (Prior Art)
FIG. 6 is a block diagram of the electronic controller assembly.

FIG. 6 is a block diagram showing the control operation of the present invention. Output from the compression and tension strain gauges 100 is input into a strain gauge bridge circuit 101. Output from the strain gauge bridge circuit is input into a microprocessor circuit 102. The microprocessor circuit also receives input from a carriage position detection circuit 103 and a keypad circuit 104, and which receives input from an electronic keypad 105. The microprocessor circuit outputs to an LED display circuit 106 such that the tension reading from the compression and tension strain gauges is displayed and also provides input into motor drive circuit 107 which in turn operatively controls a gear motor 108.

Figures 1, 2, 8:
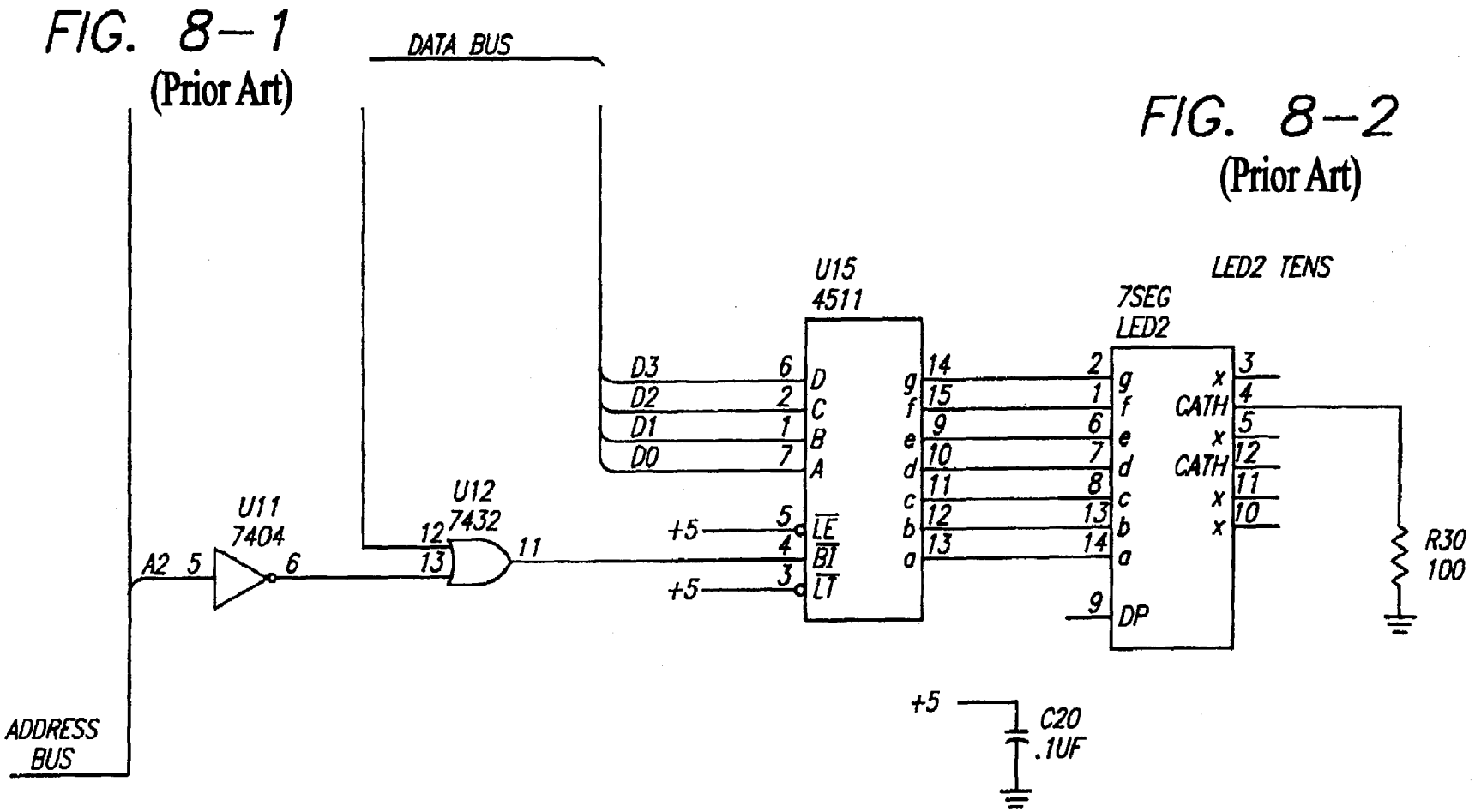
FIG. 8–2 (Prior Art)
FIG. 8–1 (Prior Art)
FIG. 8 is the display circuit schematic diagram.
Figure 9:
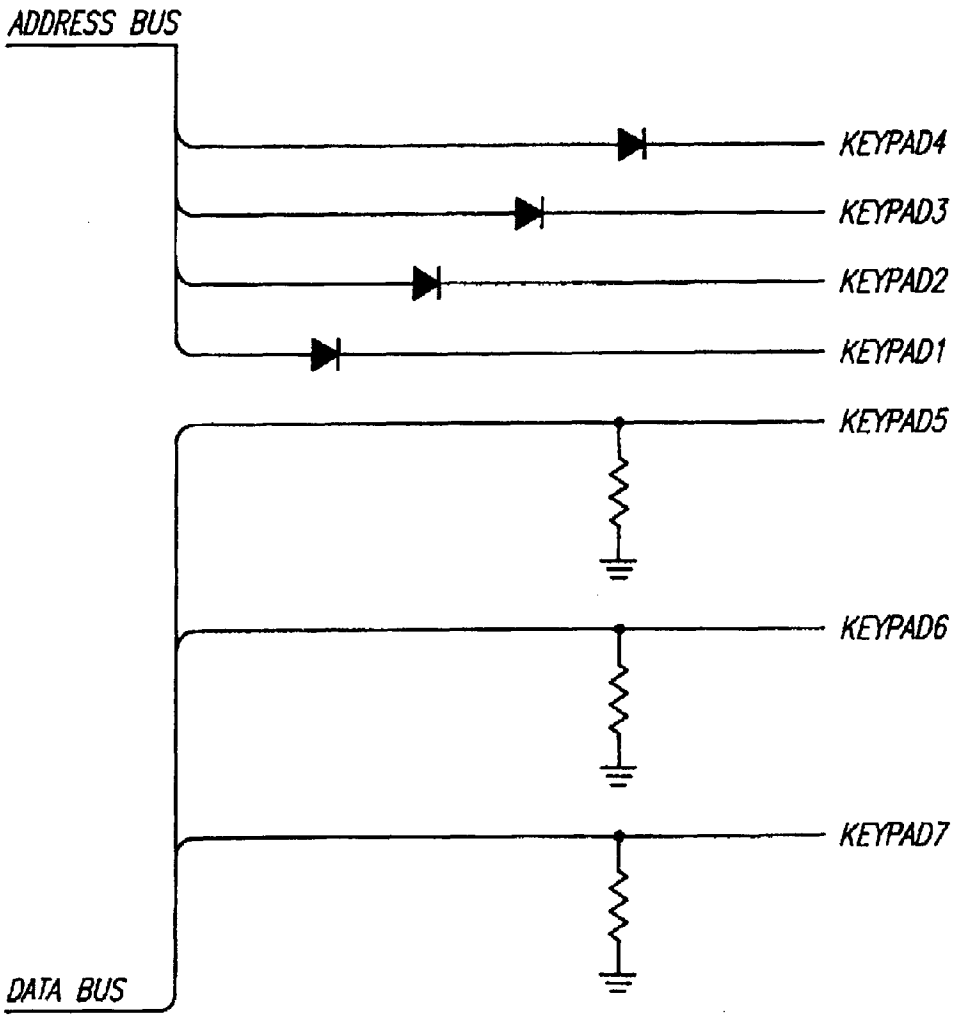
FIG. 9 (Prior Art)
FIG. 9 is the keypad circuit schematic diagram.
Figure 10A:
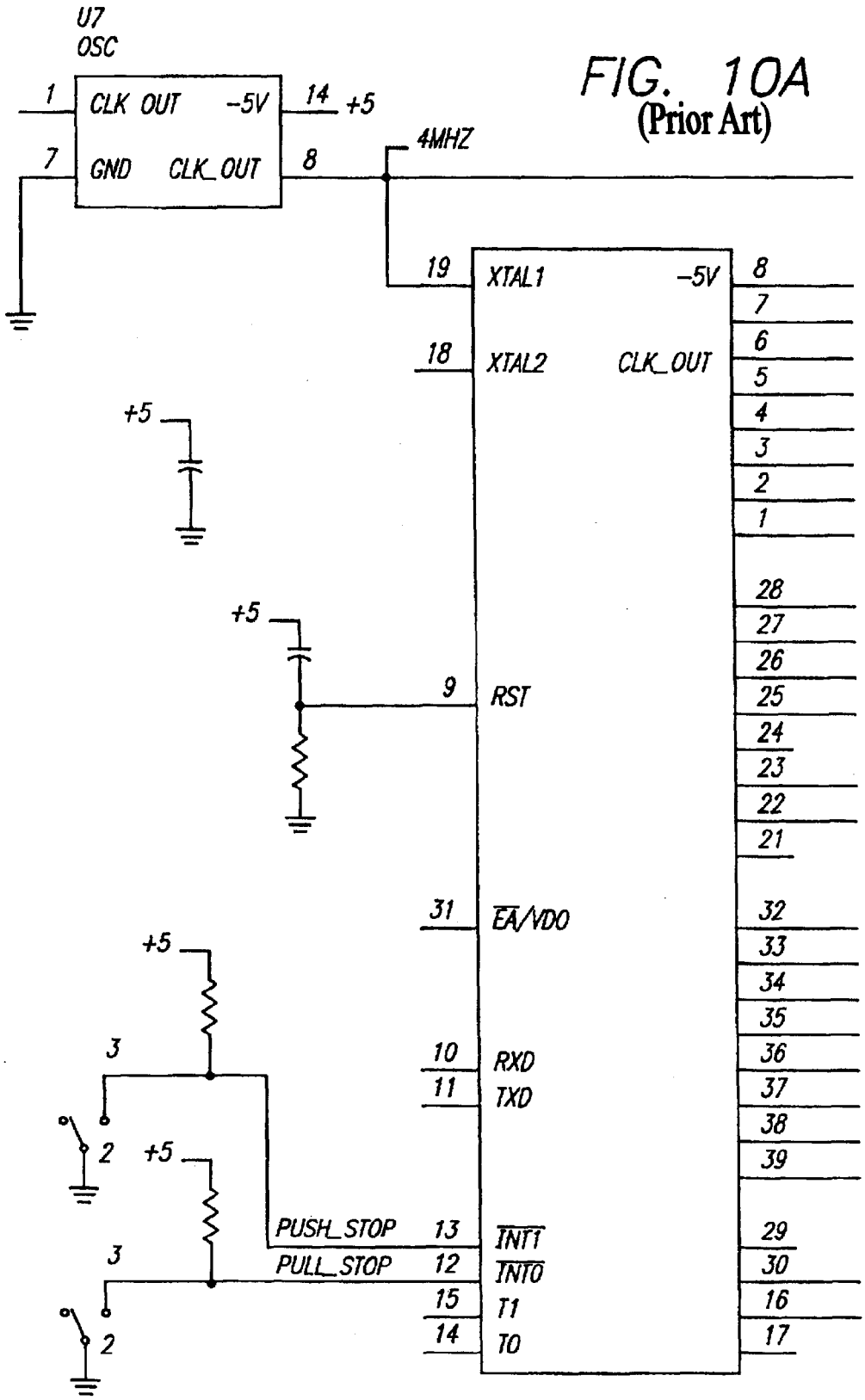
FIG. 10A (Prior Art)
FIG. 10 is the microprocessor circuit schematic diagram.
Figure 10B:
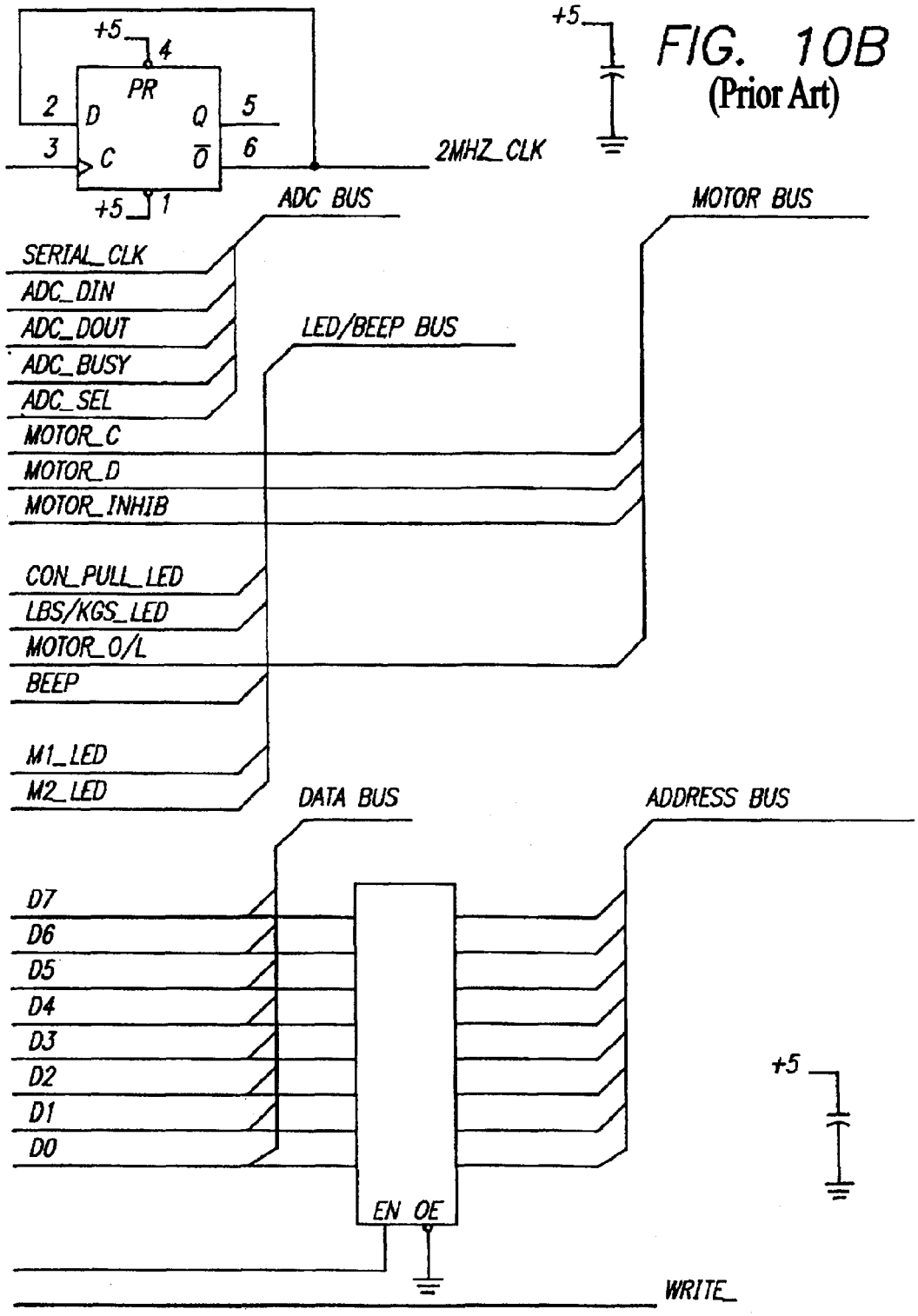
FIG. 10B (Prior Art)
Figure 13:
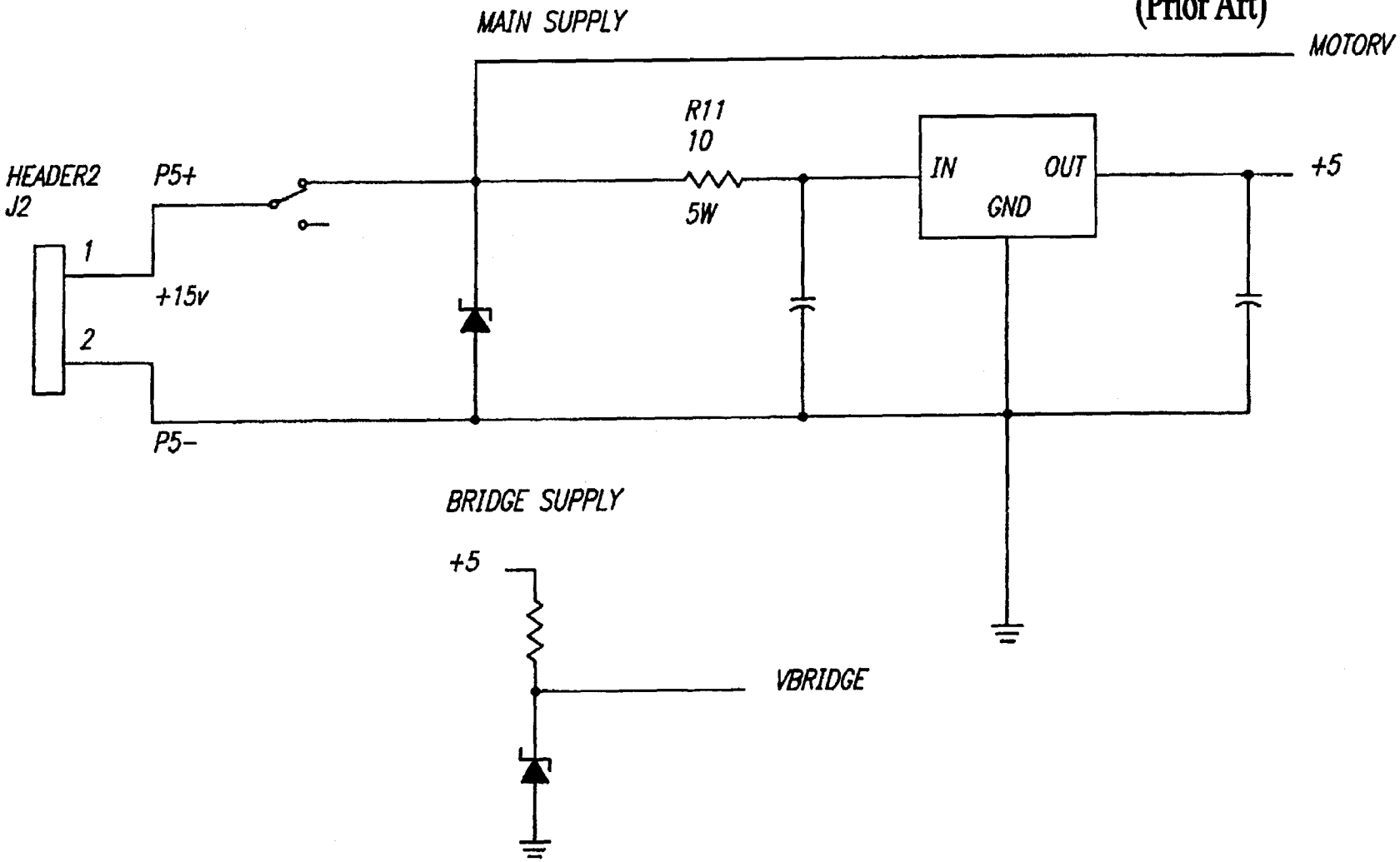
FIG. 13 (Prior Art)
FIG. 13 is the power supply circuit schematic diagram.
Figure 14:
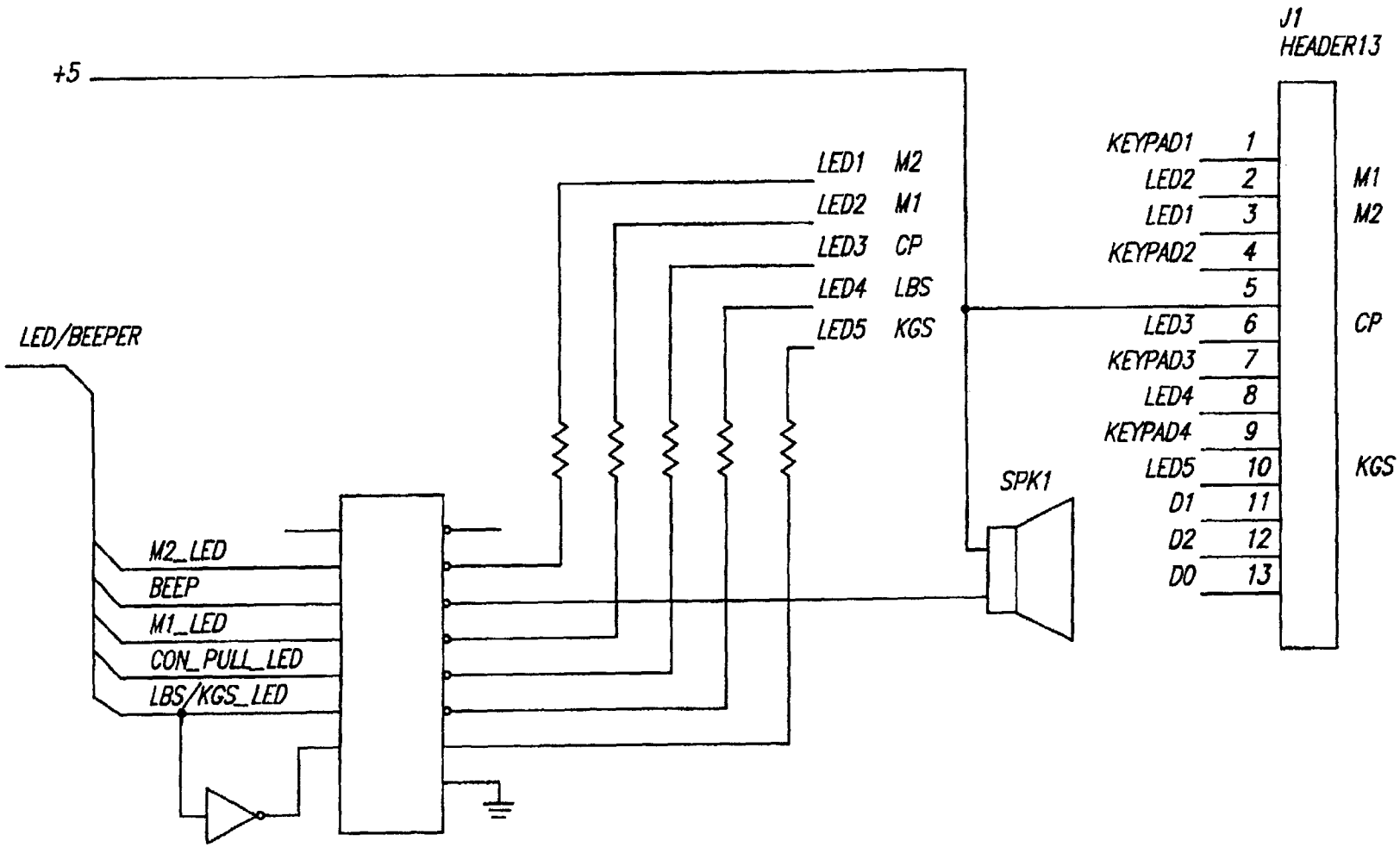
FIG. 14 (Prior Art)
FIG. 14 is the LED/beeper circuit schematic diagrams.
Figure 15:
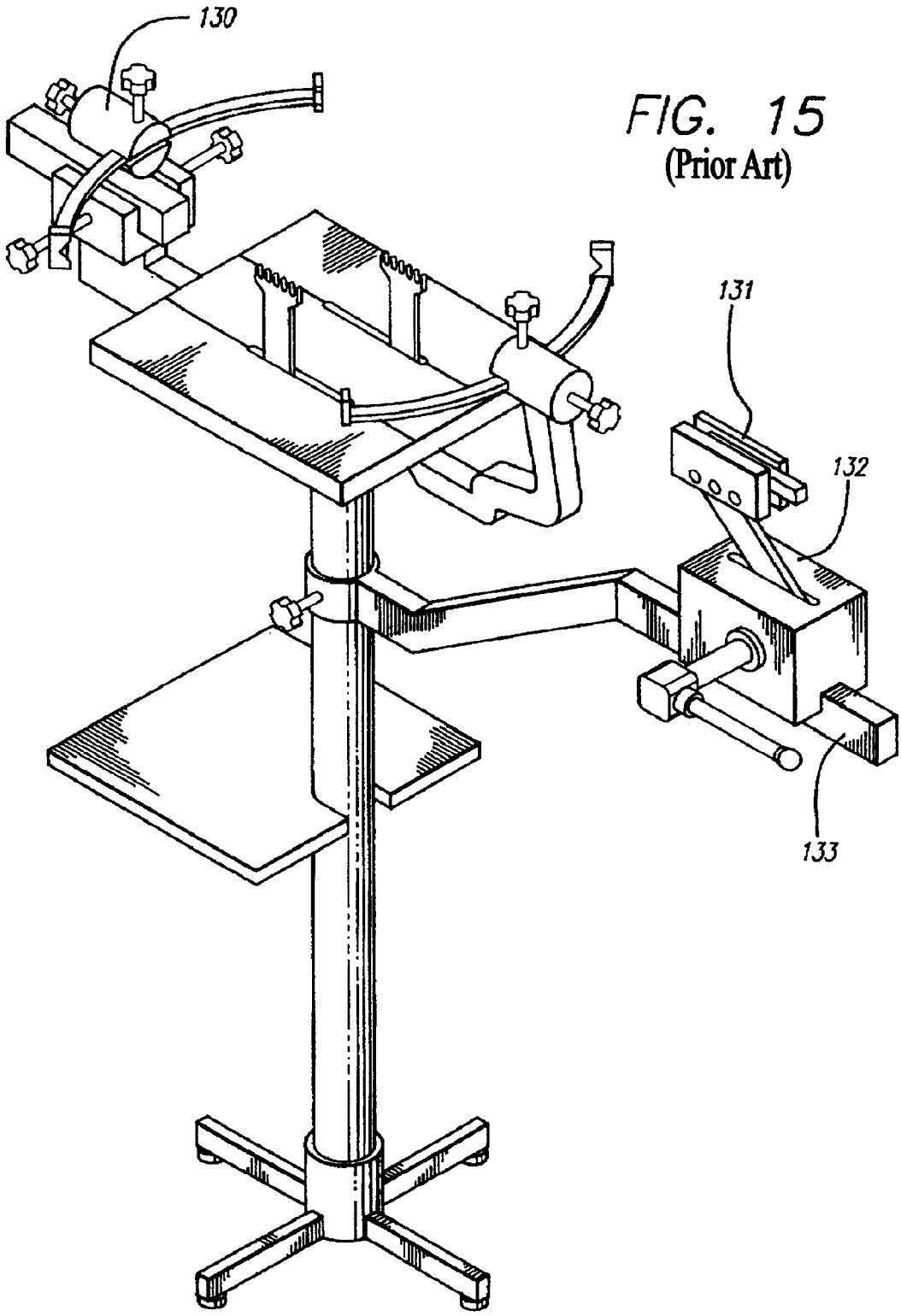
FIG. 15 (Prior Art)
FIG. 15 is a view in perspective of a conventional mechanical stringing machine.

The electronic controller assembly consists of the electronic controller circuit board onto which is mounted the electronic keypad 120 in FIG. 7. The electronic controller circuit board is mounted inside the tension head enclosure, just behind the tension head enclosure display window opening. The electronic controller circuit consists of the following sub circuits; the strain gauge bridge sub circuit, FIG. 12, the keypad sub circuit, FIG. 9, the motor controller sub circuit, FIG. 11, the LED driver sub circuit, FIG. 14, the microprocessor sub circuit, FIG. 10, the power supply sub circuit, FIG. 13 and the display sub circuit, FIG. 8.

Figure 12:
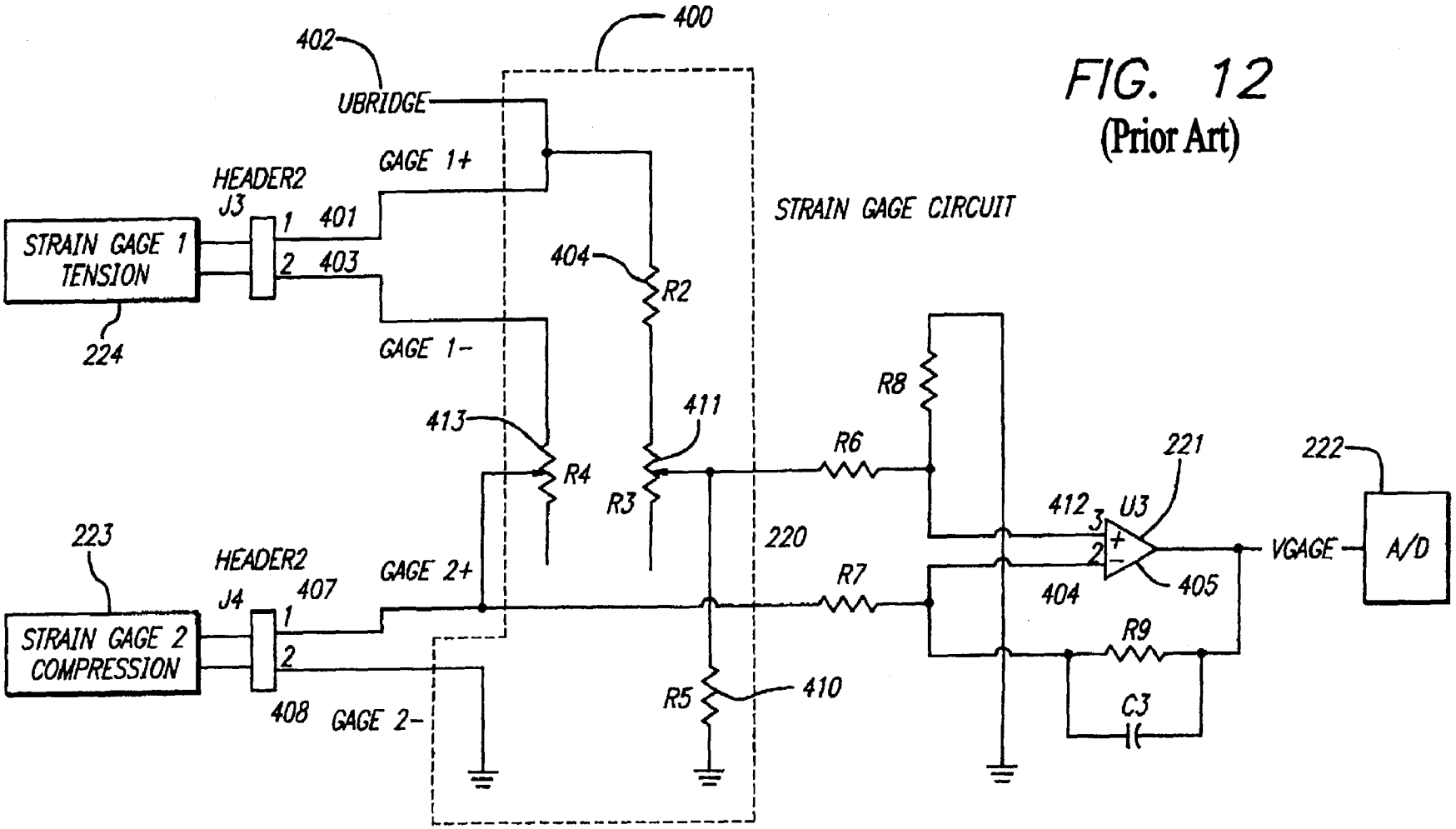
FIG. 12 (Prior Art)
FIG. 12 is the strain gauge circuit schematic diagram.

As shown in FIG. 12, the strain gauge bridge sub circuit consists of the following components; the whetstone bridge, the operational amplifier 221, and the analog to digital converter 222. Both the compression strain gauge 223 and the tension strain gauge 224 are connected to the electronic controller circuit board (preferably by a five conductor shielded cable with twisted pairs such that one of the twisted conductor pairs is connected to the two legs of the compression strain gauge, the other of the twisted conductor pairs is connected to the tension strain gauge and the shield of the said cable is connected to ground on the electronic controller circuit board). One leg of the compression strain gauge is connected to the whetstone bridge reference voltage, while the other leg of the compression strain gauge is connected to both the positive input of the operational amplifier and one leg of the tension strain gauge. The other leg of the tension strain gauge is connected to ground. Thus the two strain gauges make up one side of the whetstone bridge circuit.

Two temperature match resistors are connected accordingly to form the other side of the whetstone bridge circuit with the node connecting said resistors to the negative input of the operational amplifier.

The operation of the strain gauge bridge circuit is as follows. When a longitudinal force is exerted on the snatch vise, in a direction towards the racket cradle, a bending moment is experienced by the brace. This bending moment will create a compression strain along the surface of the brace where the compression strain gauge is located. Said bending moment will, at the same time, create a tension strain along the surface of the brace where the tension strain gauge is located. When the compression strain gauge experiences compression strain, the resistance of the compression strain gauge decreases proportionally to the force exerted on the snatch vise. When the tension strain gauge experiences a tension strain, the resistance of the tension strain gauge increases proportionally to the force exerted on the snatch vise. When the resistance of the compression strain gauge decreases while the resistance of the tension strain gauge increases, the voltage at the node connecting the two strain gauges, increases with respect to the voltage at the node connecting the resistors of the bridge together. The difference in the voltage at the two bridge nodes is known as the bridge output voltage 220. The bridge output voltage increases proportionally with the force exerted on the snatch vise. The compression strain gauge and the tension strain gauge are temperature matched, their change in resistance with temperature are the same. The two bridge resistors are also temperature matched. Therefore any resistance change in the strain gauges, due to temperature change, will be exactly the same, thus the voltage at the node where the two strain gauges are connected will not vary with change in temperature. Any resistance change in the two bridge resistors resistances, due to temperature, will also be the same, thus the voltage at the bridge node connecting the two bridge resistors together will not vary with temperature. The bridge output voltage, which is the difference in the two node voltages of the bridge, also will not vary with change in temperature. Therefore the bridge output voltage is temperature independent. The bridge output voltage 220 is fed into the operational amplifier 221 which amplifies it and feeds it to the analog to digital converter 222. The analog to digital converter converts the operational amplifier's output voltage to a 14 bit digital numerical representation. This 14 bit digital numerical representation is known as the bridgestrain.

The value of the bridgestrain is directly proportional to the force exerted on the snatch vise. The analog to digital converter is connect to the microprocessor circuit via a digital interface over which the bridgestrain value is passed to the microprocessor circuit FIG. 10.

Figure 11:
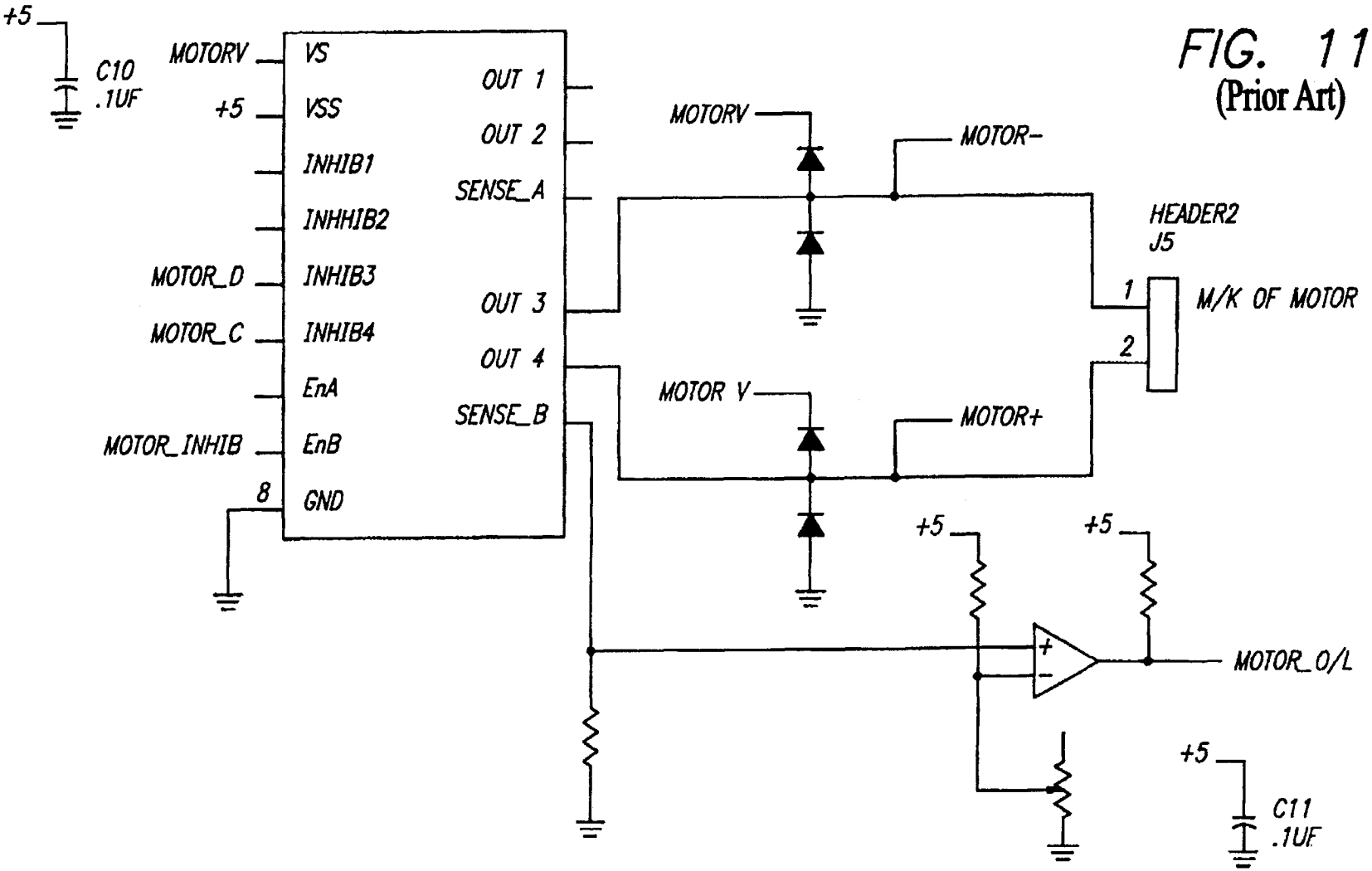
FIG. 11 (Prior Art)
FIG. 11 is the motor controller circuit schematic diagram.

The motor controller circuit FIG. 11 is driven by a digital interface with the microprocessor circuit. The motor controller circuit provides power to the gear motor. A two conductor cables connects the gear motor to the electronic assembly circuit board. The motor controller circuit can provide four combinations of power to the gear motor. The motor controller can provide a positive voltage to the gear motor, which will cause the gear motor to turn in a clockwise direction, which causes the lead screw to rotate in a clockwise direction, which in turn causes the snatch vise carriage assembly to translate in a direction away from the racket cradle. The motor controller can also provide a negative voltage to the gear motor, which causes the motor to turn in a counter clockwise direction, which caused the lead screw to rotate in a counter clockwise direction which in turns causes the snatch vise carriage assembly to translate in a direction toward the racket cradle.

The motor controller can also provide a neutral voltage to the gear motor where a neutral voltage is defined as applying the same positive voltage to both leads of the gear motor. Applying a neutral voltage to the gear motor locks the motor in its current position, causing the gear motor to resists any torque placed on it by the lead screw via a longitudinal force exerted on the snatch vise carriage assemble, essentially locking the snatch vise carriage assembly in place.

The motor controller circuit can also place no voltage on the gear motor. No voltage corresponds to placing zero volts on both leads of the gear motor. Placing no voltage on the gear motor allows the gear motor to turn when a torque is applied to the drive shaft via the lead screw, when a longitudinal force is exerted on the snatch vise carriage assembly, thus allowing the snatch vise carriage assemble to translate when a longitudinal force is exerted on the snatch vise.

The electronic keypad consists of a switch matrix with eleven switches, five LEDs and a ribbon cable. The ribbon cable connects the electronic keypad to the electronic assembly circuit board. The electronic keypad switch matrix consists of four scan lines and four read lines, where a particular scan line is connected to a particular read line when a particular switch is closed. The four scan lines and four read lines are connected to the keypad circuit. The keypad circuit sequentially places a voltage on one and only one of the scan lines at a time, and then checks the four read line for said voltage. The keypad circuit sequences through all four scan lines, before repeating the cycle. If a particular switch is pressed, the keypad circuit passed the particular switch ID to the microprocessor circuit via a digital interface.

The LED drive circuit interfaces with the microprocessor circuit via a digital interface. The LED driver circuit is connected to the electronic keypad via the electronic keypad ribbon cable. The LED driver circuit can illuminate any combination of the electronic keypad LEDs. The LED driver circuit also consists of three seven segment numerical LEDs which can be made to display any three digit number.

The carriage position detection circuit consists of two mechanical lever arm position switches, with one switch known as the pull stop switch, and the other known as the push stop switch. The pull stop switch is located on the end of the electronic assembly circuit board, furthest away from the racket cradle, while the push stop switch is located on the opposite end of the circuit board. The pull stop switch will be activated by the snatch vise carriage assembly when the snatch vise carriage assembly translates to a point furthest away from the racket cradle. The push stop switch will be activated by the snatch vise carriage assembly when the snatch vise carriage assembly translate to a point nearest the racket cradle. The outputs of both the pull stop switch and the push stop switch are connected directly to the micro-processor circuit.

In the present embodiment, the carriage position detection circuit consists of two photo-optical position sensors, with one sensor known as the pull stop sensor, and the other known as the push stop sensor. The pull stop sensor is located on the end of the electronic assembly circuit board, furthest away from the racket cradle, while the push stop sensor is located on the opposite end of the circuit board. The pull stop sensor will be activated by the snatch vise carriage assembly when the snatch vise carriage assembly translates to a point furthest away from the racket cradle. The push stop sensor will be activated by the snatch vise carriage assembly when the snatch vise carriage assembly translate to a point nearest the racket cradle. The outputs of both the pull stop sensor and the push stop sensor are connected through signal conditioner to the microprocessor circuit.

The microprocessor circuit consists of a microprocessor and support circuitry. The firmware, to run said microprocessor, resides within said microprocessor.

The microprocessor receives the following inputs; user keypad information via the keypad circuit, the bridge strain value from the bridge strain gauge circuit, and the status of both the pull stop and push stop sensor status via the snatch vise position detector circuit. The microprocessor has the following outputs; control of the gear motor via the motor controller circuit, control of both the singular LEDs and the seven segment numerical display.

Functional operation of the microprocessor circuit is controlled by the onboard firmware where said firmware performs all of the before mentioned functions of this electronic stringing device.

FIG. 7 shows the operational keypad. Power first applied to the present device initiates a self-test verifying the operation of the strain gauges, the motor drive screw assembly and the electronic controller assembly. The machine sets itself to zero, essentially calibrating itself. If the test is successful, the number 50.0 (pounds) or 22.7 (kilos) appears on the display representing a commonly used tension. The operator uses the up/down arrows to set his preferred tension if it is other than the default.

To store a new tension, the operator touches the M1 button momentarily and waits for a confirming beep and the lighting of an associated LED. Similarly the operator can store a second preference in M2. With two tensions stored in memory the operator has three tensions at his/her finger tips, M1, M2, and any other he/she sets as displayed on the display.

Prior to stringing, the operator has other controls to consider. The operator may choose to display the input tension in kilos rather than pounds. This choice will be acknowledged with a beep and a lighted LED.

The Speed control allows the rate at which the motor control assembly travels to be varied based on the operators preference after considering the capability of the string and the racket. The Count control allows for the display of the number of "pulls" or full cycle repetitions of the vise since the machine was turned on and is cumulative so long as power is on.

The Constant Pull control On/Off eliminates the enormous gap between mechanical and electronic machines. Constant Pull Off replicates the results of a traditional mechanical stringing machine wherein a brake is applied when the dialed-in tension is reached. There is no further movement of the vise even if the string looses elasticity and tension. With Constant Pull On, if the device senses a loss of tension of more than 0.5 pounds it re-applies the dialed-in tension.

Tension settings and other controls are made by the operator and displayed at the keypad. When the pulled string reaches the displayed tension, a beep sounds to indicate success. If the vise reaches its furthest extension yet has not tensioned the string as programmed, a series of beeps indicates the string reached the pull stop sensor and has not reached the dialed-in tension.

Other embodiments of the invention are shown in FIGS. 16 through 21. These embodiments define three distinctions from the embodiments described above.

One distinction is the use of a follower on the drive screw which is mounted on a guide shaft that is laterally spaced from the lead screw and in which the snatch vise assembly is mounted on the follower between the lead screw and the guide shaft, which provides more precise positioning and control of the snatch vise and less undesired random movement.

Another distinction is the use of roller bearings instead of ball bearings which prevents skewing of the snatch vise members and gives more precise and consistent tension control as well as more precise vertical alignment of the outer walls (also called outer vice plates) and the jaws of the snatch vise.

Another distinction is the use of an adjustable set screw inside one of the outer vice plates of the snatch vise with a slot interiorly and a pin in the adjacent snatch vise jaw which extends through the slot and overlays the head of the set screw, which provides an override action to compression of the snatch vise on the string and which is adjustable by adjusting the position of the set screw.

Figure 16:
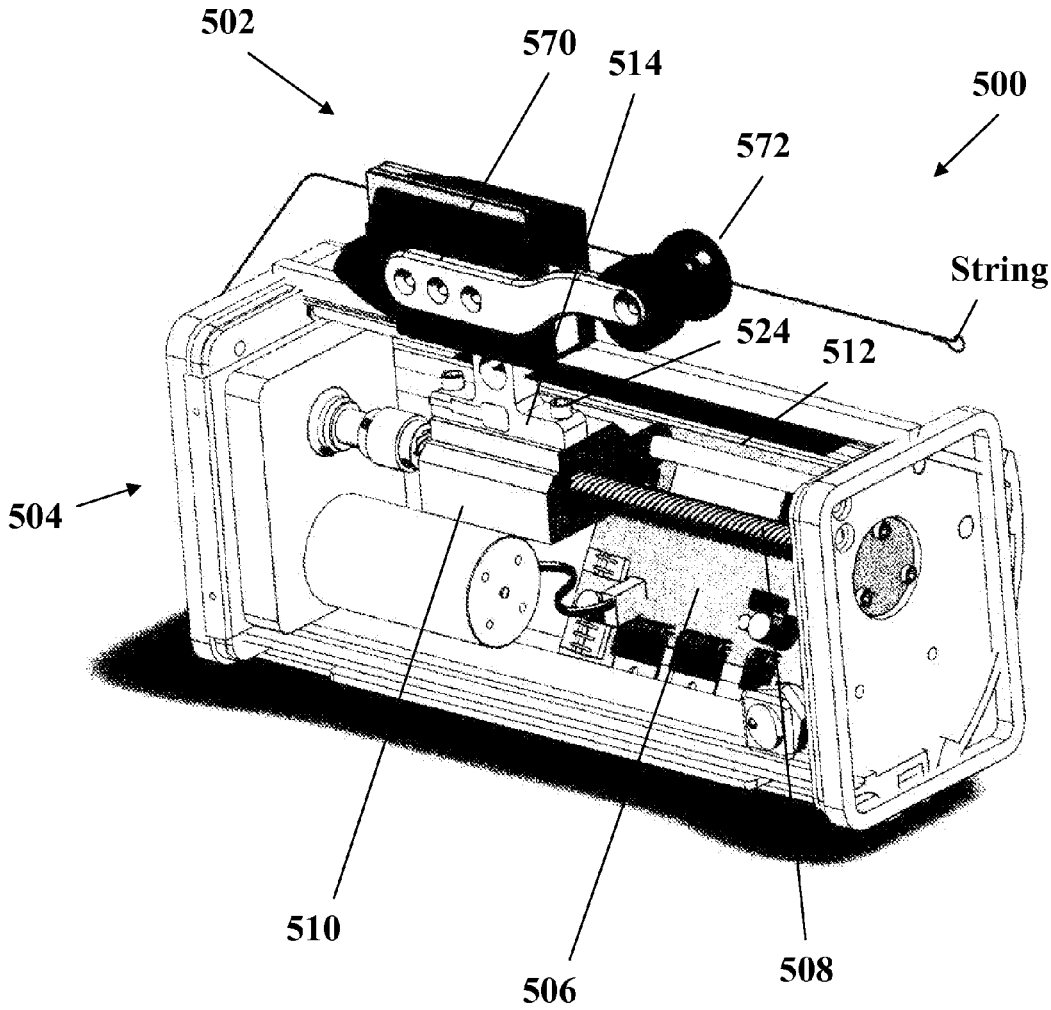
FIG. 16 is a view in perspective of a tension head assembly according to the present invention.
Figure 17:
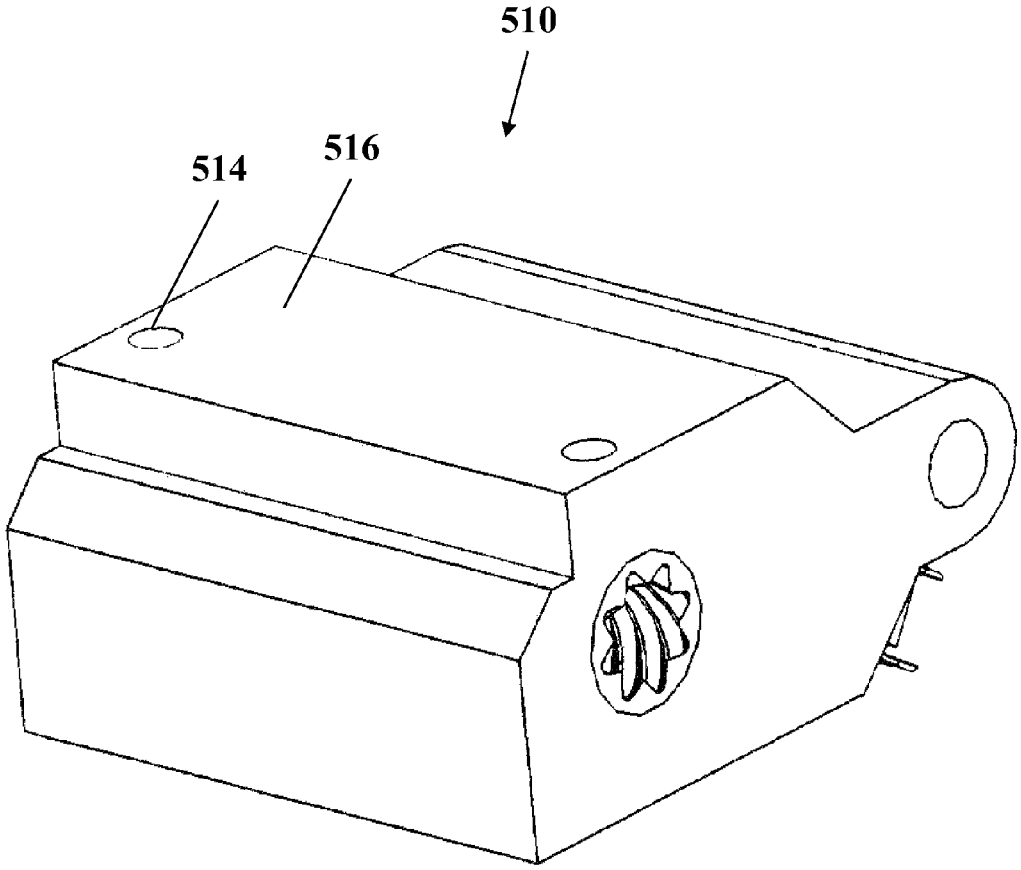
FIG. 17 is a view in perspective of the follower according to the present invention.

FIG. 16 shows the tension head assembly 500 of the present invention with a cover portion removed. It has a snatch vice assembly 502, a motor drive assembly, generally shown at 504, and an electronic control 506. The motor drive assembly comprises a lead screw 508 and a follower 510 (also shown on FIG. 17); and also a guide bar 512. The guide bar 512 is spaced laterally from the lead screw 508. The follower 510 is mounted on the lead screw 508 and on the guide bar 512. This construction keeps the follower 510 accurately and consistently oriented by preventing any rotation of the follower 510. This is important because as will be seen, the sensitive operating assemblies are mounted on the follower 510. It is distinguished from the previously described structure in that it is a single piece extending at least as long as the load cell so that the load cell is fitted to a single piece and it has a distance between the lead screw 508 and the guide bar 512 of at least one inch, which is sufficient to prevent tilting. The follower 510 is seen in more detail in FIG. 17. It has threaded mounting holes 514 in a surface 516 which are directly above the lead screw and axially spaced, on which the snatch vice is mounted via a load cell, as described below. The follower 510 is preferably made from Polyoxymethylene (POM), also known as acetyl, polyacetyl (see Delrin by DOW Chemical), and is an engineering thermoplastic that provides high stiffness, low friction and excellent dimensional stability which is required for the present application.

Figure 18:
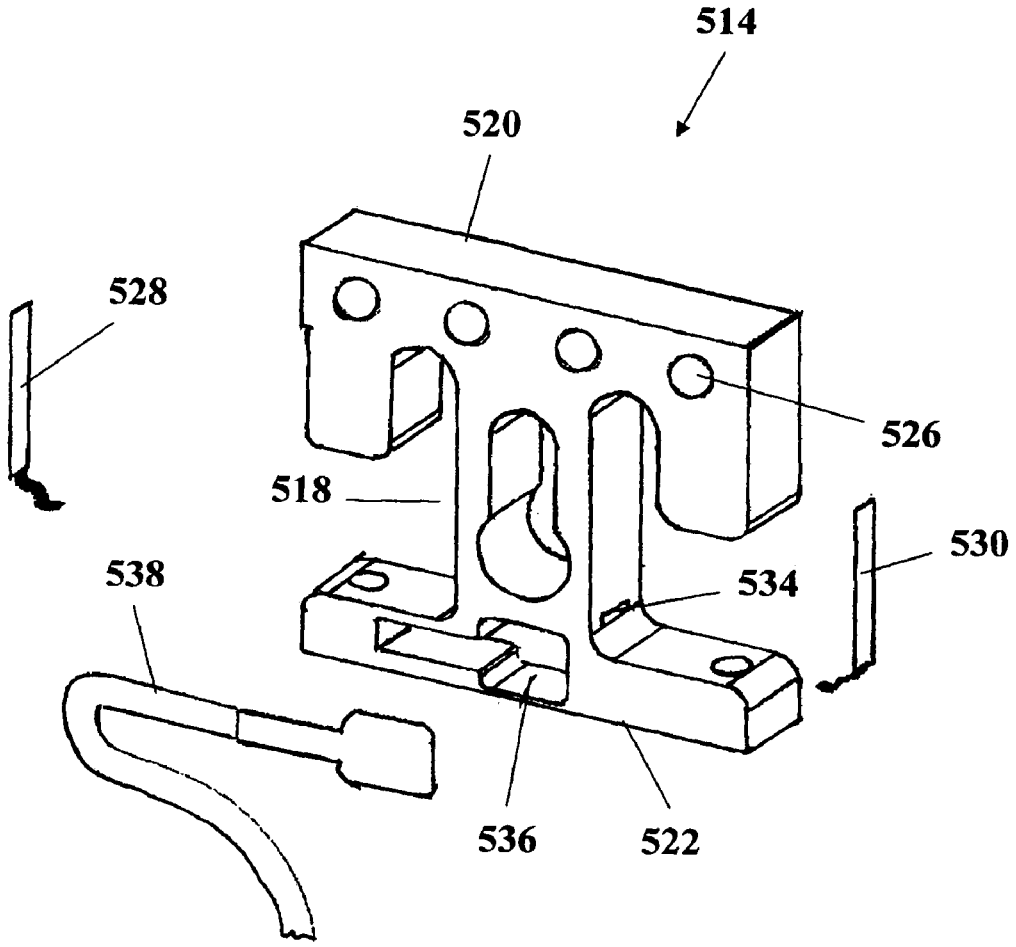
FIG. 18 is a view in perspective of the load cell according to the present invention.

Mounted directly on the follower 510 is a load cell 514 which is shown in more detail in FIG. 18. The load cell 514 has a beam 516, an upper strut 520 and a lower strut 522. The lower strut 522 is attached to the follower 510 by screws 524 (see FIG. 16) and the upper strut 520 has holes 526 for attaching it to the snatch vice as described below. Strain gauges 528 and 530 are adhered to the forward and rearward sides of the beam 518, with wires extending through openings 534 to a connection space 536 and connected to wire assembly 538 which will transmit strain signals to the electronic control 506.

Figure 19:
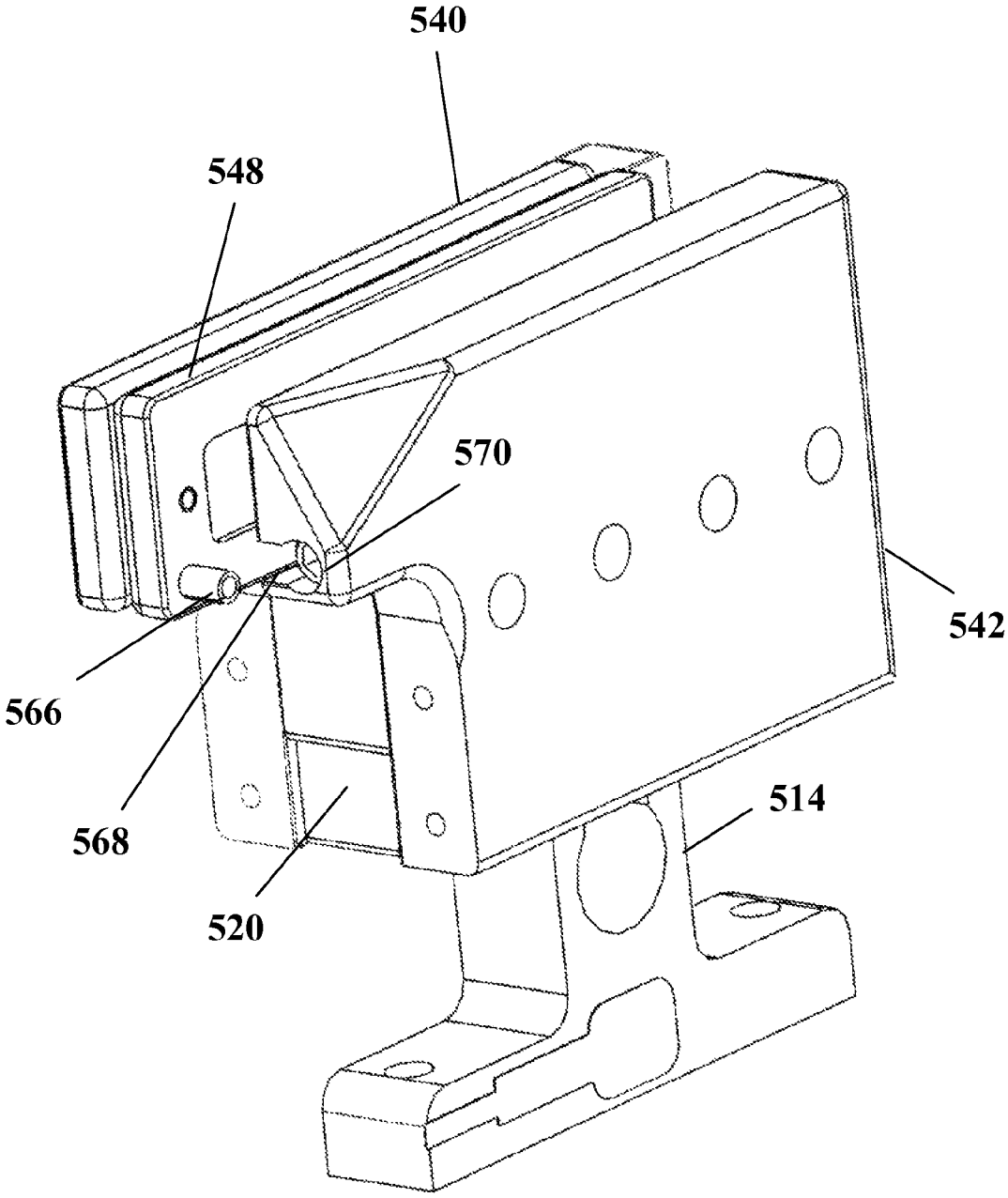
FIG. 19 is a view in perspective of the snatch vise and load cell according to the present invention.
Figure 20:
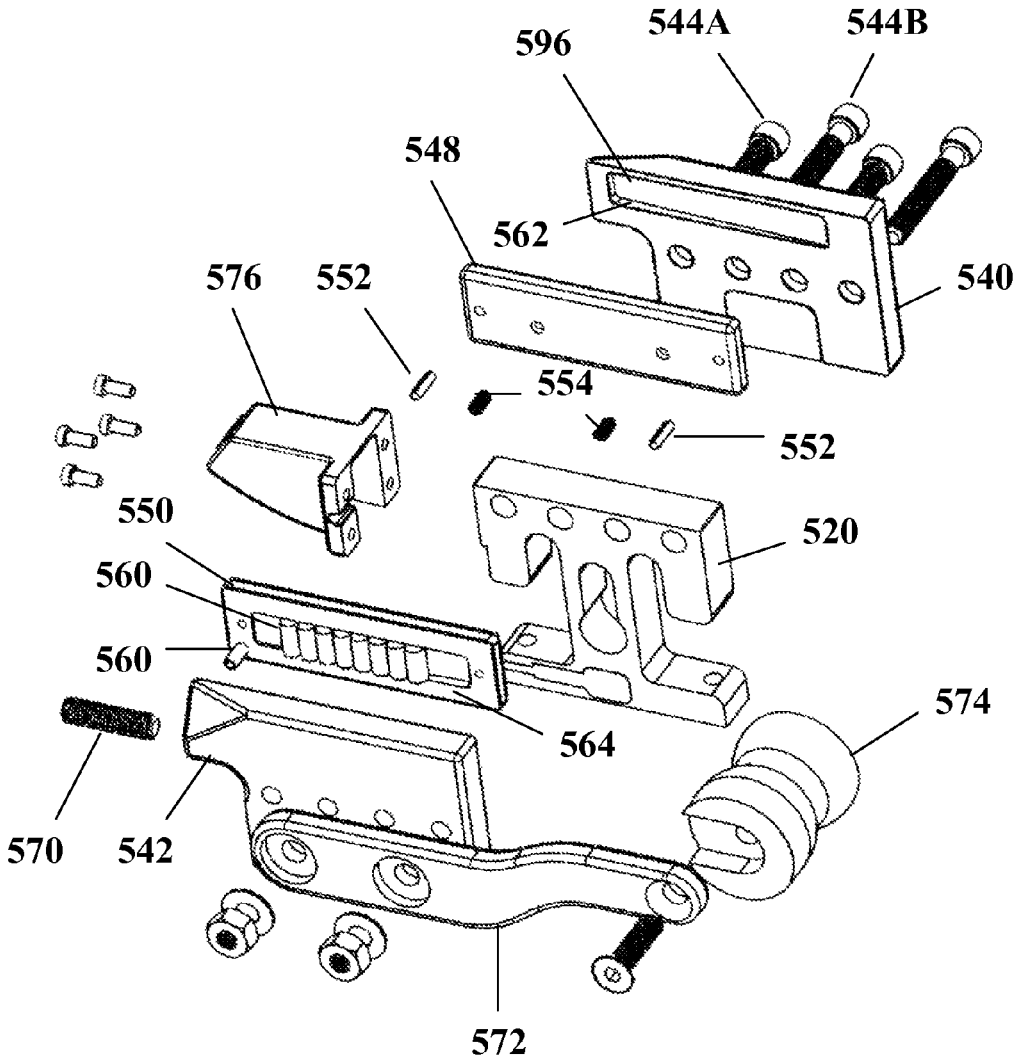
FIG. 20 is an exploded view in perspective of the snatch vise and load cell according to the present invention.
Figure 21:
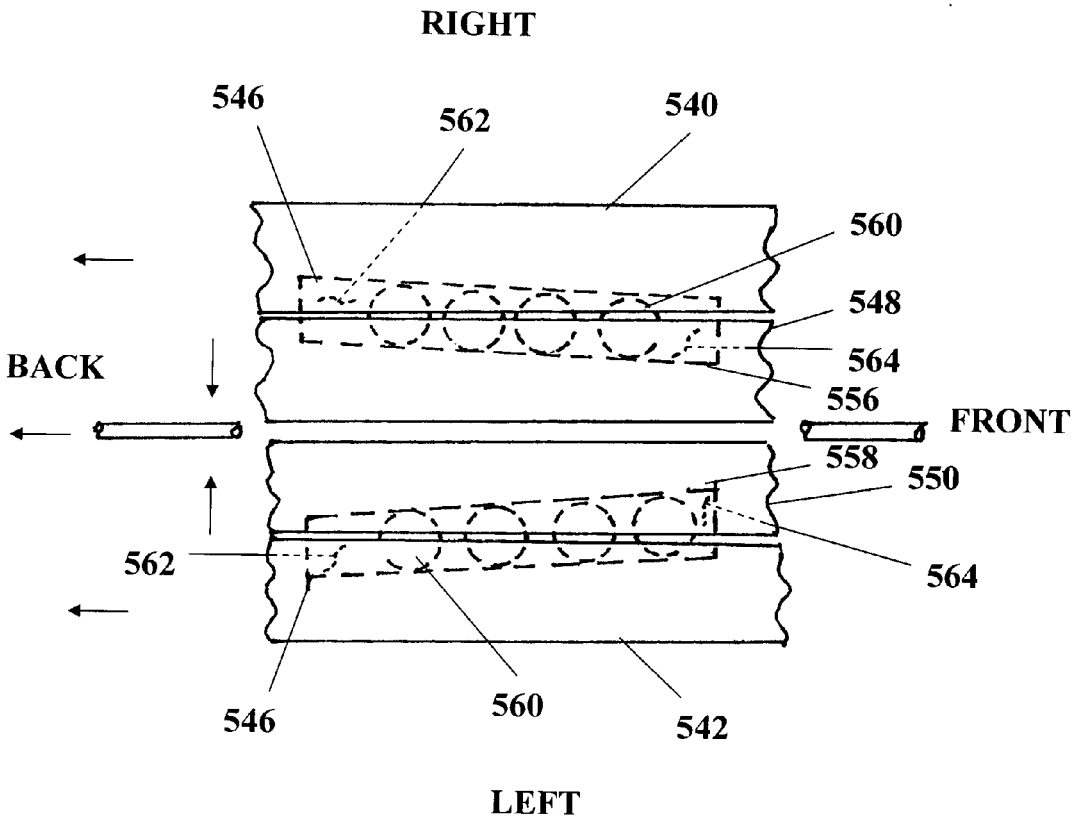
FIG. 21 is a partial view of the snatch vise showing engagement of roller bearings with the outer vice plates and the gripping jaws

The snatch vice 502 is described with reference to FIGS. 19, 20 and 21 as well as FIG. 16. For reference purposes the front of the tension head assembly will be defined as closer to the racket cradle assembly, the rear or back as further from the racket cradle assembly, the right and left is looking in from the front. As seen in FIG. 19 there is a right outer vice plate 540 and a left outer vice plate 542. They are mounted on either side of the load cell 514 and fixed to it by the bolts 544A and 544B. The outer vice plates 540 and 542 have bearing grooves or races 546 and 548 facing inwardly. As seen in FIG. 21, the depth of the grooves in the outer vice plates deepen from the front to the back.

Between the outer vice plates are left and right vice jaws 548 and 550. They are aligned to each other by roll pins 552 and they are biased apart by springs 554. The vice jaws 548 and 550 have grooves 556 and 558 respectively whose depth reduces from front to back. The variation in the groove depths of the matting outer vice plates and vice jaws are such that the space between them is constant and they carry within them roller bearings 560. The grooves of both the outer vice plates have upper and lower edges 562 and the vice jaws each have an upper and lower edge 564 which serve to capture the roller bearings by contact with their upper and lower surfaces; which prevents vertical movement and skewing, thereby keeping the vice jaws vertically fixed and aligned. The left vice jaw 548 has a pin 566 which extends to the left. The left outer vice plate 542 has a slotted threaded hole 568 into which is threaded a set screw 570. The pin 566 extends so as to enter the slot of the slotted threaded hole 568 so as to be positioned in the path of the set screw 570. The pin 566 and the slotted threaded hole 568 and the set screw 570 could also be at the right vice jaw 550 and the right outer plate 540.

On one of the outer vice plates, in this case selected to be on the left outer vice plate 542 is a Diablo 572 which has a bobbin 574 over which the string extends.

A switch mount and switch assembly 576 is mounted on the outer vice plates and is wired into the electronic control to start operation of the tension head.

In operation, a selected tension head is entered into the electronic control as described above. The string is placed between the vice jaws 548 and 550 and the start switch is activated. As the outer vice plates move rearwardly, the vice jaws will close on the string putting tension on the string which is transmitted to the load cell. The full detail of the operation of a snatch vise is well known, so it is not necessary to explain it here. When the strain on the load cell equals the string tension setting, the load cell will transmit the signal from the strain gauges and rearward movement will stop. However, if the pin 566 hits the set screw 570 before that happens, the vice jaws will not close any further because the pin will cause them to ride rearward with the outer vice plates and not be able to close any further. In that way compression of the string will not increase any further reducing the risk of damage to the string. During operation, the vertical alignment of the vice jaws and their vertical positioning with respect to the outer vice plates is fixed by the contact of the groove upper and lower edges on the upper and lower ends of the roller bearings thereby preventing any skewing or tilting.

What has been described herein is considered merely illustrative of the principles of this invention. Accordingly, it is well within the purview of one skilled in the art to provide other and different embodiments within the spirit and scope of the invention as encompassed by the following claims.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. This disclosure has been made with respect to the current state of the art, but also contemplates advancements and that adaptations in the future may take into consideration of those advancements, namely in accordance with the then current state of the art. It is intended that the scope of the invention be defined by the Claims as written and equivalents as applicable.

What is claimed is:

1. A tension head apparatus for use as part of a racquet stringing machine comprising;

a snatch vise for engaging a racket string comprising;

two spaced apart outer walls defining between them a fixed separation space;

two spaced apart vice jaws positioned in the separation space one of which being adjacent to each outer wall and operable to close the distance between them during operation and to have horizontal movement relative to the outer walls;

roller bearings set into bearing recesses in each outer wall and the adjacent vice jaw, the bearing recesses having relative bearing wall orientation such that upon rearward movement of the snatch vise with movement of the vice jaws relative to the outer walls, the roller bearings will force the vice jaws to move closer together and wherein the bearing recesses of both the outer wall and the adjacent vice jaw have upper and lower surfaces which overlay a portion of the upper and lower ends of the roller bearings thereby to constrain any relative vertical movement of the outer wall relative to the adjacent vice jaw;

a motor assembly operable to drive the snatch vise rearwardly to apply tension to a racket string in the vice jaws wherein the load cell is attached to the motor assembly;

a load cell fixed to the snatch vise and to the motor assembly and having strain gauges mounted on it to measure strain transmitted from the outer walls to the load cell during operation;

a tension setting element for setting a desired tension on the racket string and transmitting an electrical signal comparable to the tension setting;

an electronics assembly for reading the strain on the load cell and comparing it to the tension setting electrical signal and operable to cause the motor assembly to stop when the strain indicates that the desired tension has been reached;

whereby upon rearward movement of the snatch vise with a racket string between the vice jaws, the vice jaws will close on the racket string and cause tension on the racket string to the point where the tension setting is equal to the tension on the racket string whereupon the motor assembly will stop.

2. The apparatus of claim 1 wherein one of the outer walls has a threaded hole aligned with the direction of movement and a screw is in the threaded hole such that the screw head is inside the outer wall and a slot extending along the outer wall facing the adjacent vice jaw and being open to the threaded hole;

a pin in the adjacent vice jaw, the pin extending into the slot into the threaded hole and ahead of the screw head relative to the direction of movement;

whereby upon relative movement of the vice jaws to the outer walls the pin may approach and may contact the screw head thereby stopping relative movement and any further closing of the vice jaws upon a racket string between them such that the increase of pressure on a racket string by the vice jaws may be terminated notwithstanding that the tension setting has not been reached.

3. The apparatus of claim 1 further wherein the motor assembly comprises:

a lead screw having on it a follower and the load cell being fixed to the follower directly above the lead screw and the follower having a laterally extending portion, the laterally extending portion having a hole through it parallel to the axis of the lead screw; and a guide bar fixed in place parallel to the lead screw, the follower being mounted with the guide bar through the hole;

whereby upon operation of the lead screw the follower will be held rigidly in orientation by the combined lead screw and guide bar as it moves.

4. An apparatus for stringing rackets comprising:

a snatch vice;

a load cell;

a follower constructed of a single piece and having a lateral extension;

a motor control assembly having a lead screw and a parallel guide rod;

an electronic control circuit; and wherein the follower is threadedly mounted on the lead screw for axial translation upon rotation of the lead screw and the lateral extension is slidingly mounted on the guide rod and the load cell is mounted on the follower above the lead screw and the snatch vice is mounted on the load cell;

whereby upon rotation of the lead screw, the snatch vice will translate and a racquet string in the snatch vice will be pulled until a programmed tension is matched to a tension on the string determined by the load cell at which time the rotation of the lead screw will stop.

5. A tension head apparatus for use as part of a racquet stringing machine comprising;

a snatch vise for engaging a racket string comprising;

two spaced apart outer walls defining between them a fixed separation space;

two spaced apart vice jaws positioned in the separation space one of which being adjacent to each outer wall and operable to close the distance between them during operation and to have horizontal movement relative to the outer walls;

wherein one of the outer walls has a threaded hole aligned with the direction of movement and a screw is in the threaded hole such that the screw head is inside the outer wall and a slot extending along the outer wall facing the adjacent vice jaw and being open to the threaded hole;

a pin in the adjacent vice jaw, the pin extending into the slot into the threaded hole and ahead of the screw head relative to the direction of movement;

a motor assembly operable to drive the snatch vise rearwardly to apply tension to a racket string in the vice jaws wherein the load cell is attached to the motor assembly;

a load cell fixed to the snatch vise and to the motor assembly and having strain gauges mounted on it to measure strain transmitted from the outer walls to the load cell during operation;

a tension setting element for setting a desired tension on the racket string and transmitting an electrical signal comparable to the tension setting;

an electronics assembly for reading the strain on the load cell and comparing it to the tension setting electrical signal and operable to cause the motor assembly to stop when the strain indicates that the desired tension has been reached;

whereby upon rearward movement of the snatch vise with a racket string between the vice jaws, the vice jaws will close on the racket string and cause tension on the racket string to the point where the tension setting is equal to the tension on the racket string whereupon the motor assembly will stop and further whereby upon relative movement of the vice jaws to the outer walls the pin may approach and may contact the screw head thereby stopping relative movement and any further closing of the vice jaws upon a racket string between them such that the increase of pressure on a racket string by the vice jaws may be terminated notwithstanding that the tension setting has not been reached.

* * * * *